US009316986B2

(12) United States Patent
Nagasako et al.

(10) Patent No.: US 9,316,986 B2
(45) Date of Patent: Apr. 19, 2016

(54) RECORDING MEDIUM DISCHARGING DEVICE

(71) Applicants: Shuuya Nagasako, Kanagawa (JP); Masahiro Tamura, Kanagawa (JP); Tomohiro Furuhashi, Kanagawa (JP); Keisuke Sugiyama, Tokyo (JP); Yuusuke Shibasaki, Kanagawa (JP); Kyosuke Nakada, Kanagawa (JP); Kazuya Yamamoto, Kanagawa (JP); Junya Suzuki, Miyagi (JP); Kazunori Konno, Miyagi (JP); Yasuo Niikura, Miyagi (JP); Tomomichi Hoshino, Kanagawa (JP); Akira Kunieda, Tokyo (JP); Takahiro Watanabe, Kanagawa (JP); Tomohiro Yoshizaki, Saitama (JP); Kiichiro Goto, Kanagawa (JP)

(72) Inventors: Shuuya Nagasako, Kanagawa (JP); Masahiro Tamura, Kanagawa (JP); Tomohiro Furuhashi, Kanagawa (JP); Keisuke Sugiyama, Tokyo (JP); Yuusuke Shibasaki, Kanagawa (JP); Kyosuke Nakada, Kanagawa (JP); Kazuya Yamamoto, Kanagawa (JP); Junya Suzuki, Miyagi (JP); Kazunori Konno, Miyagi (JP); Yasuo Niikura, Miyagi (JP); Tomomichi Hoshino, Kanagawa (JP); Akira Kunieda, Tokyo (JP); Takahiro Watanabe, Kanagawa (JP); Tomohiro Yoshizaki, Saitama (JP); Kiichiro Goto, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 0 days.

(21) Appl. No.: 14/717,581

(22) Filed: May 20, 2015

(65) Prior Publication Data

US 2015/0253716 A1 Sep. 10, 2015

Related U.S. Application Data

(63) Continuation of application No. 13/780,020, filed on Feb. 28, 2013, now Pat. No. 9,075,377.

(30) Foreign Application Priority Data

Mar. 9, 2012 (JP) ..... 2012-052927

(51) Int. Cl.

| | |
|---|---|
| ***G03G 15/00*** | (2006.01) |
| ***G03G 21/00*** | (2006.01) |
| ***B65H 29/00*** | (2006.01) |
| ***B65H 31/00*** | (2006.01) |
| ***B65H 29/12*** | (2006.01) |
| ***B65H 29/14*** | (2006.01) |
| ***B65H 29/24*** | (2006.01) |
| *G03G 21/20* | (2006.01) |

(52) U.S. Cl.

CPC ..... *G03G 15/6552* (2013.01); *B65H 29/125* (2013.01); *B65H 29/14* (2013.01); *B65H 29/245* (2013.01); *G03G 21/206* (2013.01)

(58) Field of Classification Search

CPC ... G03G 15/00; G03G 21/00; G03G 15/6552; G03G 21/206; B65H 29/00; B65H 31/00

USPC ..... 399/405; 271/189

See application file for complete search history.

(56) References Cited

U.S. PATENT DOCUMENTS

| | | | | |
|---|---|---|---|---|
| 4,202,618 | A * | 5/1980 | Waschk | G03G 21/206 219/216 |
| 4,893,137 | A * | 1/1990 | Ebinuma | B41J 2/1652 346/134 |
| 6,611,667 | B2 * | 8/2003 | Kaiho | G03G 15/6552 399/405 |
| 7,374,164 | B2 | 5/2008 | Gaissert et al. | |
| 2001/0046398 | A1 | 11/2001 | Horikoshi | |
| 2002/0063380 | A1 | 5/2002 | Tamura et al. | |
| 2002/0079642 | A1 | 6/2002 | Tamura et al. | |
| 2002/0158405 | A1 | 10/2002 | Nagasako et al. | |

| | | | | |
|---|---|---|---|---|
| 2003/0156850 | A1 | 8/2003 | Tsutada | |
| 2006/0093420 | A1 | 5/2006 | Oba | |
| 2008/0044213 | A1 | 2/2008 | Kato et al. | |
| 2010/0254721 | A1 | 10/2010 | Fukita et al. | |
| 2012/0070215 | A1* | 3/2012 | Murakami | G03G 15/6573 399/405 |
| 2012/0093555 | A1 | 4/2012 | Obuchi | |
| 2012/0229837 | A1 | 9/2012 | Kubo | |
| 2014/0029999 | A1 | 1/2014 | Masuta | |
| 2014/0145395 | A1* | 5/2014 | Takano | B65H 31/26 271/211 |
| 2014/0369711 | A1 | 12/2014 | Kubo | |

FOREIGN PATENT DOCUMENTS

| | | | | | |
|---|---|---|---|---|---|
| CN | 1736835 | A | | 2/2006 | |
| JP | 62085264 | A | * | 4/1987 | G03G 15/00 |
| JP | H09-34321 | | | 2/1997 | |
| JP | H11-30891 | | | 2/1999 | |
| JP | 11282327 | A | * | 10/1999 | G03G 21/20 |
| JP | 2000095414 | A | | 4/2000 | |
| JP | 2001-242769 | A | | 9/2001 | |
| JP | 2003002500 | | | 1/2003 | |
| JP | 2004043113 | A | | 2/2004 | |
| JP | 2005067843 | A | * | 3/2005 | B65H 31/38 |
| JP | 2006126249 | A | | 5/2006 | |
| JP | 2007197142 | A | | 8/2007 | |
| JP | 2009249071 | | | 10/2009 | |
| JP | 2010-132372 | A | | 6/2010 | |
| JP | 2010132372 | A | | 6/2010 | |
| JP | 2010224283 | A | | 10/2010 | |
| JP | 2010256866 | A | | 11/2010 | |
| JP | 2010286525 | A | * | 12/2010 | G03G 21/20 |
| JP | 2011017980 | A | * | 1/2011 | B65H 31/26 |
| JP | 2011017980 | A | | 1/2011 | |
| JP | 2011-057313 | A | | 3/2011 | |
| JP | 2011084359 | A | | 4/2011 | |
| JP | 2011102936 | A | | 5/2011 | |
| JP | 2011227319 | A | * | 11/2011 | G03G 15/00 |
| JP | 2012013882 | A | | 1/2012 | |
| WO | WO-2011058887 | A1 | | 5/2011 | |

OTHER PUBLICATIONS

Office Action for corresponding Chinese application No. 201310075039.5 dated Feb. 28, 2015 and English translation thereof.
Office Action for corresponding Japanese application No. 2012-052927 dated Jun. 30, 2015.

* cited by examiner

*Primary Examiner* — Nguyen Ha
(74) *Attorney, Agent, or Firm* — Harness, Dickey & Pierce, P.L.C.

(57) ABSTRACT

A recording medium discharging device includes a discharging unit configured to discharge a recording medium from a discharge port; a tray unit on which the recording medium discharged from the discharging unit is stacked; and an air blower configured to blow air in a direction substantially parallel to a direction in which the recording medium is discharged.

3 Claims, 16 Drawing Sheets

RECORDING MEDIUM DISCHARGING DEVICE

CROSS-REFERENCE TO RELATED APPLICATION

This application is a continuation application of and claims priority under 35 U.S.C. §120/121 to U.S. application Ser. No. 13/780,020 filed Feb. 28, 2013, which claims priority under 35 U.S.C. §119 to Japanese Patent Application No. 2012-052927 filed in Japan on Mar. 9, 2012, the entire contents of each of which are hereby incorporated herein by reference.

BACKGROUND

1. Field of the Invention

Example embodiments relate to a discharging device of a recording medium in an image forming apparatus.

2. Description of the Related Art

An image forming apparatus includes a tray unit onto which a recording medium such as paper on which an image is formed is discharged from an inside of the image forming apparatus and stacked. When discharged, the recording medium is fed out in a direction extending along a surface of the tray unit and stacked on the surface of the tray unit at a predetermined position and in a predetermined posture. If recording media are discharged one after another consecutively, the recording media are stacked in sequence on the surface of the tray unit.

If, however, the recording medium has a weak stiffness and thus has a leading end drooping or curling, or otherwise faulty, the recording medium may be discharged with its leading end rounded depending on properties or conditions thereof. In such cases, the leading end of the recording medium being discharged is directed toward the surface of the tray unit, thus contacting the surface of the tray unit at an acute contact angle. This results in a discharge fault occurring, such as the recording medium being stacked out of a predetermined correct position or a predetermined correct posture.

FIG. 27 illustrates an exemplary discharge fault representing rounding of the recording medium. Referring to FIG. 27, an image forming apparatus F includes a discharging roller R and a tray unit T and discharges a recording medium M in a discharging direction P. FIG. 27 illustrates that the recording medium M has a rounded leading end and the leading end of the recording medium M and a surface of the tray unit T define a contact angle $\alpha$ of nearly 90°.

Such an acute contact angle results in a discharging fault occurring, such as the recording medium M being out of the correct stack position, stacked slantwise, or stacked on the surface of the tray unit of the tray unit T in a rolled-up posture.

Japanese Patent Application Laid-open No. 2010-132372 discloses a technique in an image forming apparatus, the technique incorporating fans that generate air flow in an upper portion and a lower portion of a discharging part for discharging the recording medium.

In the technique disclosed in Japanese Patent Application Laid-open No. 2010-132372, while a recording medium is being discharged, a lower fan is rotated to generate a wind force that is used to raise a leading end of the recording medium to thereby ensure that the leading end of the recording medium does not curl downwardly; the instant that a trailing end of the recording medium moves past a discharging roller, the lower fan is stopped and, instead, an upper fan is rotated to generate a wind force that is used to force the trailing end of the recording medium downwardly, so that the recording medium can be stacked on a discharge tray.

The technique disclosed in Japanese Patent Application Laid-open No. 2010-132372, however, involves complicated arrangements. Specifically, for example, the technique requires both the lower fan and the upper fan, the lower fan being rotated to generate the wind force for raising the leading end of the recording medium and the upper fan being rotated to generate the wind force for forcing the trailing end of the recording medium downwardly. In addition, the technique requires that drives for the lower and upper fans be switched between each other.

SUMMARY

It is an object of example embodiments to at least partially solve the problems in the conventional technology.

According to an example embodiment, there is provided a recording medium discharging device that includes a discharging unit configured to discharge a recording medium from a discharge port; a tray unit on which the recording medium discharged from the discharging unit is stacked; and an air blower configured to blow air in a direction substantially parallel to a direction in which the recording medium is discharged.

According to another example embodiment, there is provided an image forming apparatus that includes the recording medium discharging device according to the above embodiment.

The above and other objects, features, advantages and technical and industrial significance of this invention will be better understood by reading the following detailed description of presently preferred embodiments of the invention, when considered in connection with the accompanying drawings.

DETAILED DESCRIPTION OF EXAMPLE EMBODIMENTS

First Exemplary Embodiment

A first embodiment of the present invention will be described below with reference to FIGS. 1 to 10.

Configuration of First Exemplary Embodiment

Figure 1:
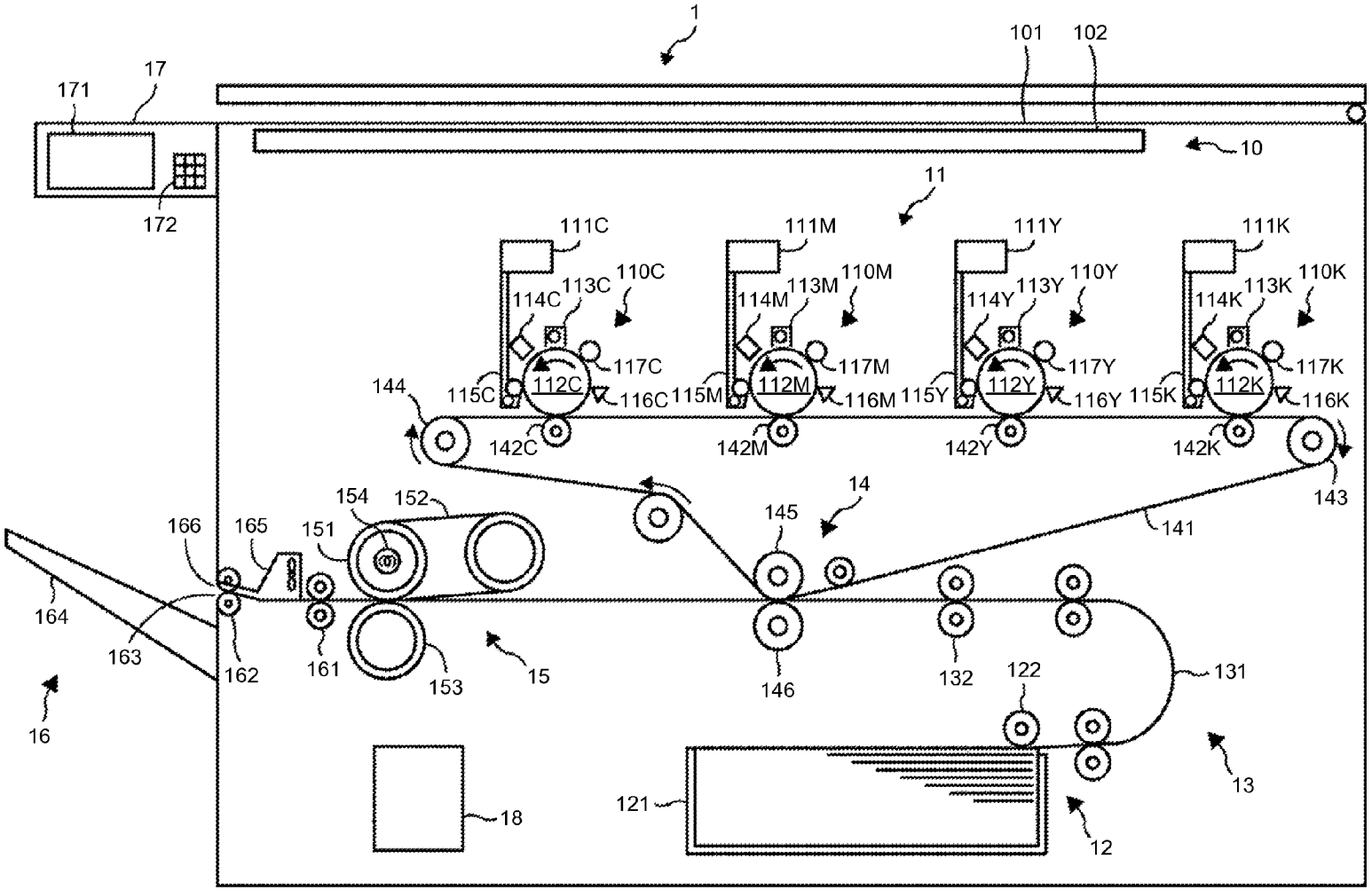
FIG. 1 is a general configuration diagram illustrating an image forming apparatus 1 according to a first example embodiment.

An image forming apparatus according to the first example embodiment will be described below with reference to FIGS. 1 to 6. FIG. 1 is a general configuration diagram illustrating an image forming apparatus 1 according to the first example embodiment. The image forming apparatus 1 causes a toner image to be affixed to a sheet of paper (hereinafter, simply referred to as a sheet) as an exemplary recording medium to thereby form an image. The image forming apparatus 1 includes a scanning unit 10, an image forming unit 11, a sheet feeding unit 12, a conveying unit 13, a transferring unit 14, a fixing unit 15, a discharging unit 16, an operating unit 17, and a control unit 18.

The scanning unit 10 scans an image of a document. The scanning unit 10 includes a contact glass 101 and an image scanning unit 102. The scanning unit 10 optically scans the image of the document placed on the contact glass 101 using the image scanning unit 102 that includes an optical system and a scanning sensor to thereby generate image information that represents the image of the document.

The image forming unit 11 forms a toner image using toner of each of different colors of cyan (C), magenta (M), yellow (Y), and black (K). The image forming unit 11 includes image formers 110C, 110M, 110Y, 110K, each forming a toner image of a corresponding color. It is noted that the image formers 110C, 110M, 110Y, 110K share a common configuration and, in a description that follows to describe the common configuration, the symbols representing the different colors of toner, specifically, C, M, Y, and K will be omitted and the image former of any color of toner will simply be referred to as the "image former 110". Similarly, each of different units constituting the image former 110 will also be denoted a reference numeral with C, M, Y, or K omitted.

The image former 110 includes a toner supply unit 111, a photosensitive element 112, a charging unit 113, an exposing unit 114, a developing unit 115, a cleaning unit 116, and a neutralization unit 117. The toner supply unit 111 stores therein toner of a specific color associated with a corresponding image former 110 and supplies toner to the developing unit 115. The photosensitive element 112 is rotatably driven in a direction of an arrow and disposed so as to be in contact with an intermediate transfer belt 141 of the transferring unit 14. Additionally, the charging unit 113, the exposing unit 114, the developing unit 115, the cleaning unit 116, and the neutralization unit 117 are disposed in sequence along a rotating direction of the photosensitive element 112.

The charging unit 113 uniformly charges a surface of the photosensitive element 112. The exposing unit 114 includes a semiconductor laser not illustrated and irradiates the surface of the photosensitive element 112 with a laser beam to thereby form an electrostatic latent image. The developing unit 115 affixes toner to the photosensitive element 112 to thereby form a toner image. The cleaning unit 116 removes any residual toner left on the surface of the photosensitive element 112. The neutralization unit 117 optically illuminates the surface of the photosensitive element 112 for neutralization.

The sheet feeding unit 12 feeds a sheet toward the conveying unit 13. The sheet feeding unit 12 includes a sheet storage 121 and a sheet feeding roller 122. The sheet storage 121 accommodates stacked sheets. The sheet feeding roller 122 feeds the top of the sheets from the stacked sheets in the sheet storage 121 onto the conveying unit 13.

The conveying unit 13 conveys a sheet from the sheet feeding unit 12 to the discharging unit 16. The conveying unit 13 includes a conveying path 131, registration rollers 132, and a plurality of sheet detecting sensors not illustrated. The conveying path 131 is configured such that sheet is conveyed from the sheet feeding unit 12 onto the discharging unit 16 by way of the transferring unit 14 and the fixing unit 15. The registration rollers 132 are disposed at a position immediately before the transferring unit 14 along the conveying path 131. The sheet fed off by the sheet feeding roller 122 is conveyed along the conveying path 131 onto the registration rollers 132. The registration rollers 132 feed the conveyed sheet toward the transferring unit 14 to be in time for a secondary transfer to be described later.

Each of the sheet detecting sensors detects a sheet on the conveying path 131 and that the sheet has conveyed onto a predetermined position, for example, the discharging unit 16.

The sheet detecting sensors are disposed at a plurality of positions along the conveying path 131, detecting a sheet present on a specific position between the positions along the conveying path 131. In addition, in order to detect that the sheet has been conveyed onto a predetermined position, a sheet detecting sensor is disposed at a position immediately before the predetermined position on the conveying path 131 to thereby detect that the sheet has moved past the predetermined position. For example, to detect that the sheet has conveyed onto the discharging unit 16, a sheet detecting sensor is disposed at a position on the conveying path 131 immediately before the discharging unit 16.

The transferring unit 14 performs a primary transfer and a secondary transfer. The "primary transfer" refers to transferring the toner image formed on the surface of the photosensitive element 112 onto the intermediate transfer belt 141. The "secondary transfer" refers to transferring the toner image on the intermediate transfer belt 141 onto sheet fed off from the registration rollers 132. The transferring unit 14 includes the intermediate transfer belt 141, primary transfer rollers 142C, 142M, 142Y, and 142K, a drive roller 143, a driven roller 144, a secondary transfer roller 145, and a secondary transfer opposite roller 146.

The primary transfer rollers 142C, 142M, 142Y, and 142K are disposed so as to be paired up with, respectively, photosensitive elements 112C, 112M, 112Y, and 112K of respective colors of toner across the intermediate transfer belt 141. The primary transfer is performed through the foregoing configuration. The configuration for the primary transfer is common to all colors. Thus, in describing the common configuration for all colors in the following, symbols denoting colors of C, M, Y, and K will be omitted and the primary transfer roller for a specific color and the photosensitive element for a specific color will be simply referred to as the "primary transfer roller 142" and the "photosensitive element 112", respectively. Through the primary transfer, the toner image of each color is transferred onto the same position on the intermediate transfer belt 141 to thereby form a single color toner image that represents toner images of different colors superposed one on top of another.

The intermediate transfer belt 141 is rotated by the drive roller 143 and the driven roller 144. The secondary transfer roller 145 and the secondary transfer opposite roller 146 are disposed so as to sandwich therebetween the sheet conveyed from the registration rollers 132 and the intermediate transfer belt 141. The secondary transfer is performed at a nip between the secondary transfer roller 145 and the secondary transfer opposite roller 146, so that the color toner image transferred to the intermediate transfer belt 141 is transferred onto the sheet.

The fixing unit 15 fixes the color toner image transferred by the transferring unit 14 onto the sheet on the sheet. The fixing unit 15 includes a fixing roller 151, a fixing belt 152, a fixing opposite roller 153, and a heat generating unit 154. Through the foregoing configuration, heat and pressure are simultaneously applied to the color toner image transferred onto the sheet to thereby melt a resin component of the toner in the sheet. The color toner image is thus fixed on the sheet. The heat generating unit 154 heats the fixing roller 151 to a predetermined fixing temperature, whereby heat required for toner melting is applied to the fixing belt 152. The fixing roller 151 and the fixing opposite roller 153 nip to press the heated fixing belt 152 and the sheet onto which the toner image has been transferred, thereby fixing the toner.

Figure 2:
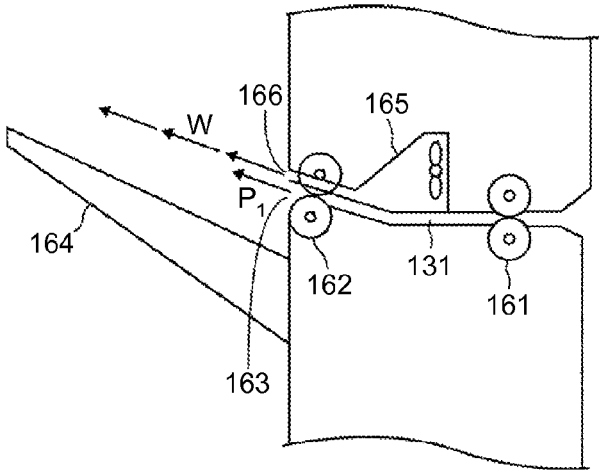
FIG. 2 is a configuration diagram illustrating a discharging unit 16 according to the first example embodiment.
Figure 3:
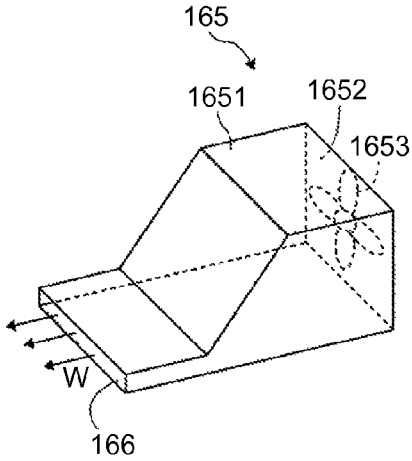
FIG. 3 is a configuration diagram illustrating an air blowing unit 165 according to the first example embodiment.

The discharging unit 16 discharges the sheet on which the toner has been fixed by the fixing unit 15 out of the image forming apparatus 1. The discharging unit 16 will be described with reference to FIGS. 1 to 3. FIG. 2 is a configuration diagram illustrating the discharging unit 16 according to the first embodiment. FIG. 3 is a configuration diagram illustrating an air blowing unit 165 according to the first embodiment. Referring to FIGS. 1 and 2, the discharging unit 16 includes a conveying roller 161, a discharging roller 162, a discharging port 163, a tray unit 164, the air blowing unit 165, and an air blowing port 166.

The conveying roller 161 is disposed at a position on the conveying path 131 near an inlet of the discharging unit 16 and conveys a sheet into the discharging unit 16. The discharging roller 162 is disposed at a position on the conveying path 131 near the discharging port 163 and discharges sheet in a discharging direction $P_1$ that is obliquely upward relative to the discharging port 163. The tray unit 164 is mounted on a side of the image forming apparatus 1. The sheet discharged from the discharging port 163 by the discharging roller 162 is stacked on an upper surface of the tray unit 164. The upper surface of the tray unit 164 is a slightly upwardly inclined surface toward the discharging direction $P_1$ of the sheet. The discharging direction P1 of the sheet by the discharging roller 162 extends along this inclined surface.

Referring to FIG. 3, the air blowing unit 165 includes a housing 1651, an intake port 1652, an air blowing fan 1653, and the air blowing port 166. The housing 1651 has a cylindrical shape having the intake port 1652 in a back surface and the air blowing port 166 in a front surface. The intake port 1652 has a cross-sectional area Ai greater than a cross-sectional area Ao of the air blowing port 166 (Ai>Ao). The air blowing fan 1653 is disposed inside the housing 1651. The air blowing fan 1653 draws air through the intake port 1652 in the back surface of the housing 1651 and air flow W is blown out through the air blowing port 166 in the front surface of the housing 1651. The air blowing unit 165 is disposed such that the air blowing port 166 is positioned outwardly on a side surface of the image forming apparatus 1 immediately above the discharging port 163. The air flow W blown out of the air blowing port 166 is set to have a blowing direction that extends slightly obliquely upwardly in parallel with the discharging direction P1 of the sheet discharged by the discharging roller 162.

Figure 4:
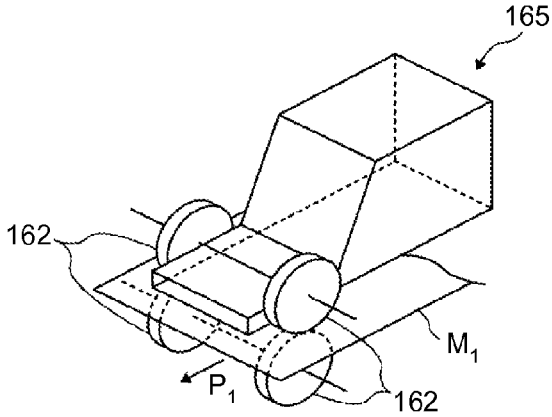
FIG. 4 is a configuration diagram illustrating the air blowing unit 165 and a discharging roller 162 according to the first example embodiment.

FIG. 4 is a configuration diagram illustrating the air blowing unit 165 and the discharging roller 162 according to the first embodiment. Referring to FIG. 4, the air blowing port 166 of the air blowing unit 165 has both sides sandwiched between an upper roller of the discharging roller 162 and is disposed downwardly of a rotating shaft of the upper roller. Additionally, the air blowing port 166 has a lower surface disposed close to an upper surface of a sheet $M_1$ discharged by the discharging roller 162.

Given the foregoing configuration, the sheet $M_1$ is discharged from downward of the air blowing port 166 in the discharging direction $P_1$. Referring to FIG. 2, the air flow W blown out of the air blowing port 166 is blown in parallel with the discharging direction $P_1$ of the sheet. The air flow W reduces air pressure on the upper surface of the sheet $M_1$ discharged from the discharging port 163. This produces a pressure difference between the upper surface and the lower surface of the sheet $M_1$ and the pressure difference generates a force in the sheet $M_1$ to resist a gravitational force and lift.

Referring back to FIG. 1, the operating unit 17 includes a touch panel 171 and a ten-key pad 172. A user uses the operating unit 17 to input information, such as image forming conditions, to the image forming apparatus 1.

Figure 5:
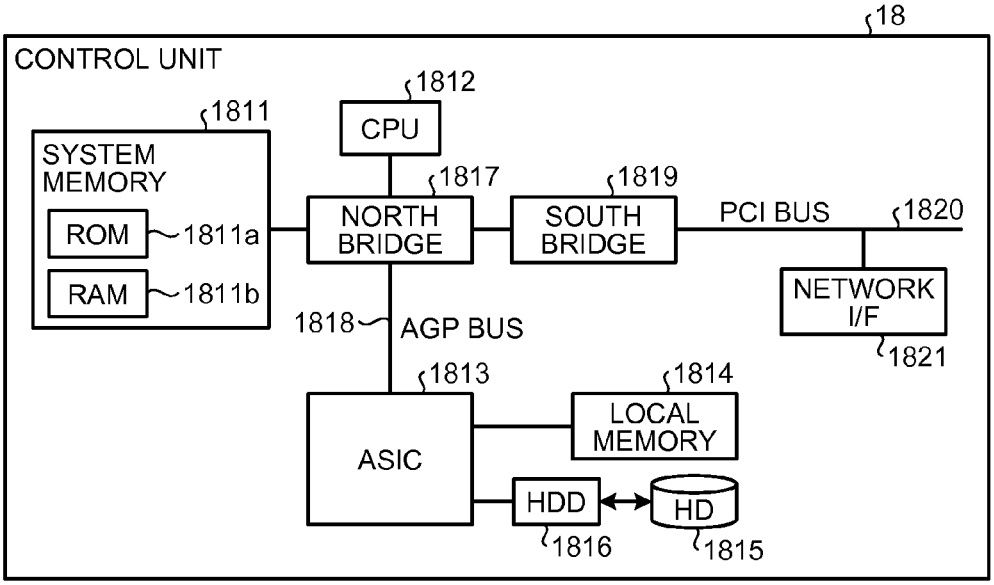
FIG. 5 is a hardware configuration diagram illustrating a control unit 18 according to the first example embodiment.

The control unit 18, for example, processes and calculates image information and controls general operations of the image forming apparatus 1. A hardware configuration of the control unit 18 will be described below with reference to FIG. 5. FIG. 5 is a hardware configuration diagram illustrating the control unit 18 according to the first embodiment. Referring to FIG. 5, the control unit 18 includes system memory 1811, a central processing unit (CPU) 1812, an application specific integrated circuit (ASIC) 1813, local memory 1814, a hard disk (HD) 1815, a hard disk drive (HDD) 1816, a north bridge 1817, an accelerated graphics port (AGP) bus 1818, a south bridge 1819, a PCI bus 1820, and a network I/F 1821.

The system memory 1811 is a storage area of the control unit 18 and includes a read only memory (ROM) 1811*a* and a random access memory (RAM) 1811*b*. The ROM 1811*a* stores therein programs and data that achieve various functions of the control unit 18. The RAM 1811*b* serves, for example, as memory for loading programs and data.

The CPU 1812, for example, processes and calculates image information according to a program stored in the system memory 1811 and controls operations of the scanning unit 10, the image forming unit 11, the sheet feeding unit 12, the conveying unit 13, the transferring unit 14, the fixing unit 15, and the discharging unit 16. The ASIC 1813 is an IC for use in image processing. The ASIC 1813 is connected to the north bridge 1817, the local memory 1814, and the HDD 1816.

The local memory 1814 is used as a copying image buffer and a code buffer. The HD 1815 is storage for storing image data, font data used for printing, and forms. The HDD 1816 controls reading and writing of data relative to the HD 1815.

The north bridge 1817 is a bridge for connecting the CPU 1812, the system memory 1811, the ASIC 1813, and the south bridge 1819. The north bridge 1817 and the ASIC 1813 are connected together via the AGP bus 1818. The AGP bus 1818 is a bus for a graphics accelerator card developed for speeding up graphics processing.

The south bridge 1819 connects to the north bridge 1817 and to the PCI bus 1820. The south bridge 1819 is connected to interfaces not illustrated, such as those for the universal serial bus (USB) and the Institute of Electrical and Electronics Engineers 1394 (IEEE 1394), via which the south bridge 1819 is connected to a PCI device and a peripheral device. The network I/F 1821 is an interface board that transmits and receives information to and from an external device, such as an information processing apparatus, over a communication network. The network I/F 1821 is connected to the south bridge 1819 via the PCI bus 1820.

Figure 6:
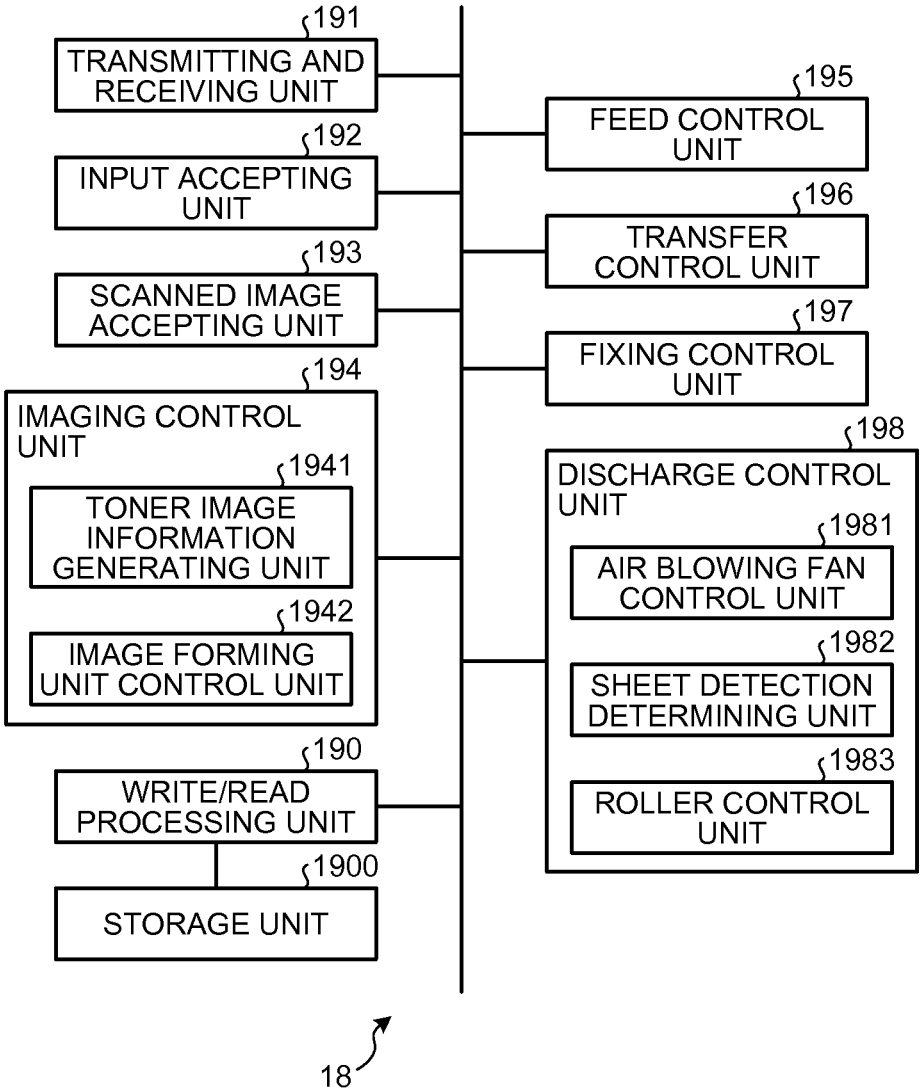
FIG. 6 is a functional configuration diagram illustrating the control unit 18 according to the first example embodiment.

A functional configuration of the control unit 18 will be described below with reference to FIG. 6. Referring to FIG. 6, the control unit 18 includes a transmitting and receiving unit 191, an input accepting unit 192, a scanned image accepting unit 193, an imaging control unit 194, a feed control unit 195, a transfer control unit 196, a fixing control unit 197, a discharge control unit 198, a write/read processing unit 190, and storage unit 1900.

The storage unit 1900 is formed to include the ROM 1811*a*, the RAM 1811*b*, and the HD 1815 illustrated in FIG. 5. The write/read processing unit 190 writes and reads various types of data to and from the storage unit 1900. All units but the storage unit 1900 represent functions achieved by respective elements that constitute the control unit 18 illustrated in FIG. 5 as the respective elements are operated by an instruction from the CPU 1812 according to the program stored in the ROM 1811*a*.

The transmitting and receiving unit 191 transmits and receives various types of information, such as image information, to and from an external device, such as an information processing apparatus, over a communication network. The input accepting unit 192 accepts various type of information input by the user from the operating unit 17. The scanned image accepting unit 193 accepts image information of the document input from the scanning unit 10.

The imaging control unit 194 includes a toner image information generating unit 1941 and an image forming unit control unit 1942. The toner image information generating unit 1941 generates toner image information based on the image information input from the transmitting and receiving unit 191 or the scanned image accepting unit 193. The "toner image information" refers to information indicating a toner image of each color formed on each photosensitive element 112 with each color (C, M, Y, K) of toner of the image former 110. The toner image of each color is superposed one on top of another to form an image based on the image information. The image forming unit control unit 1942 controls operation of each unit of the image former 110 for each color.

The feed control unit 195 controls feed operations of the sheet feeding unit 12. The transfer control unit 196 controls operations of the transferring unit 14 in order for the transferring unit 14 to perform the primary transfer and the secondary transfer. The fixing control unit 197 controls fixing operations of the fixing unit 15.

The discharge control unit 198 includes an air blowing fan control unit 1981, a sheet detection determining unit 1982, and a roller control unit 1983. The air blowing fan control unit 1981 controls air blow of the air blowing unit 165. The air blowing fan control unit 1981 rotates the air blowing fan 1653 at a predetermined air blowing fan speed previously stored in the storage unit 1900. The speed of the air blowing fan 1653 is determined based on, for example, weight, size, and thickness of sheet and a discharging speed such that a pressure difference to keep raising the sheet over a predetermined distance from the discharging port 163 in the discharging direction $P_1$ is produced between the upper surface and the lower surface of the sheet. The sheet detection determining unit 1982 determines whether there is a sheet on the conveying path 131 and whether the sheet has conveyed onto the discharging unit 16 based on an output from the sheet detecting sensor. The roller control unit 1983 controls operations of the discharging roller 162.

General Operations of First Embodiment

Figure 7:
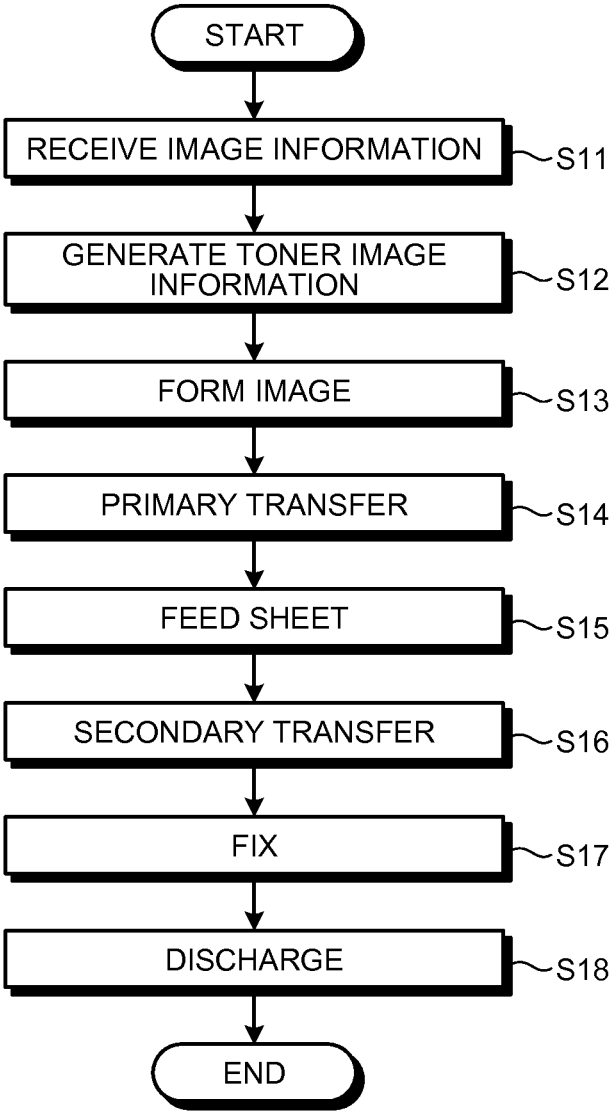
FIG. 7 is a flowchart illustrating general operations of the image forming apparatus 1 according to the first example embodiment.

General operations of the first embodiment will be described below with reference to FIGS. 7 to 10. FIG. 7 is a flowchart illustrating the general operations of the image forming apparatus 1 according to the first embodiment.

Referring to FIG. 7, the transmitting and receiving unit 191 or the scanned image accepting unit 193 of the control unit 18 first receives or accepts image information of the image of a document (Step S11).

Based on the received image information, the toner image information generating unit 1941 of the control unit 18 generates toner image information for each color that serves as information for forming a toner image (Step S12).

After the toner image information has been generated, the image forming unit control unit 1942 operates the image former 110 of each color to thereby form a toner image of each color on the surface of the photosensitive element 112 for each color (Step S13). Specifically, based on the toner image information for each color generated at Step S12 and in the image former 110 associated with each color, the exposing unit 114 irradiates the surface of the photosensitive element 112 with a laser beam to thereby form an electrostatic latent image; then, the developing unit 115 affixes toner to the surface of the photosensitive element 112 on which the electrostatic latent image is formed to thereby form the toner image of each color.

The transferring unit 14 performs a primary transfer as controlled by the transfer control unit 196. Specifically, the transferring unit 14 transfers the toner image of each color formed on the surface of each photosensitive element 112 to the intermediate transfer belt 141, in sequence, to thereby form a single color toner image (Step S14).

The sheet feeding unit 12 feeds sheet as controlled by the feed control unit 195 (Step S15). The sheet that has reached the registration rollers 132 is fed out toward the secondary transfer roller 145 in time with a timing at which the portion on the intermediate transfer belt 141 on which the color toner image is formed reaches the position of the secondary transfer roller 145.

Next, the transferring unit 14 performs a secondary transfer as controlled by the transfer control unit 196 to transfer the color toner image on the intermediate transfer belt 141 onto the sheet (Step S16).

The sheet on which the color toner image has been transferred is conveyed onto the fixing unit 15. The fixing unit 15 then fixes the color toner image as controlled by the fixing control unit 197 (Step S17).

The sheet on which the color toner image has been fixed is conveyed onto the discharging unit 16. The discharging unit 16 discharges the sheet as controlled by the discharge control unit 198 (Step S18).

Control of the air blowing unit 165 during a discharge operation will be described below with reference to FIG. 8. The sheet detection determining unit 1982 determines whether the sheet has been conveyed onto the discharging unit 16 based on a result of detection made by the sheet detecting sensor (Step S181). If the sheet detection determining unit 1982 determines that the sheet has been conveyed onto the discharging unit 16, the air blowing fan control unit 1981 rotates the air blowing fan 1653 to thereby start blowing air (Step S182).

The roller control unit 1983 then rotates the discharging roller 162 to thereby discharge the sheet that has reached the discharging unit 16 out of the discharging port 163 (Step S183). After the sheet has been discharged, the sheet detection determining unit 1982 further determines whether another sheet of paper has been conveyed onto the discharging unit 16 based on the result of detection made by the sheet detecting sensor (Step S184).

Upon determining that the another sheet of paper has not been conveyed onto the discharging unit 16, the sheet detection determining unit 1982 determines whether a sheet is present at any position on the conveying path 131 based on the result of detection made by the sheet detecting sensor (Step S185). If it is determined that another sheet of paper has been conveyed onto the discharging unit 16, the operation returns to Step S183 and another sheet of paper that has reached the discharging unit 16 is discharged.

If it is determined at Step S185 that no sheet is present at any position on the conveying path 131, the air blowing fan control unit 1981 stops rotation of the air blowing fan 1653 to thereby stop blowing air (Step S186), so that the discharge operation is terminated. If it is determined at Step S185 that a sheet is present at any position on the conveying path 131, the operation returns to Step S184 to continue the discharge operation.

Figure 9:
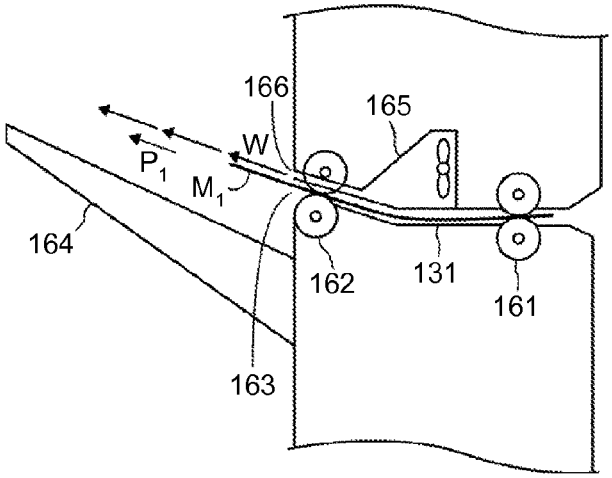
FIG. 9 is a diagram illustrating behavior of a sheet M1 at timing immediately after a start of discharge according to the first example embodiment.

Behavior of the sheet M1 during discharging by the air blow will be described below with reference to FIGS. 9 and 10. It is noted that, in FIGS. 9 and 10, like parts are denoted similarly as in FIGS. 1 and 2. FIG. 9 is a diagram illustrating behavior of the sheet $M_1$ at timing immediately after a start of discharge according to the first embodiment.

Referring to FIG. 9, the air flow W is blown out of the air blowing port 166 disposed upwardly of the discharging port 163 in parallel with the discharging direction $P_1$ of the sheet $M_1$. The air flow W causes air pressure on the upper surface of the sheet $M_1$ discharged from the discharging port 163 to be reduced, which produces a pressure difference between the upper surface and the lower surface of the sheet $M_1$. The pressure difference generates a force in the sheet $M_1$ to resist a gravitational force and lift. In a condition immediately following the start of the discharge of the sheet $M_1$ in which the leading end of the sheet $M_1$ is being discharged from the discharging port 163, this force in the sheet $M_1$ prevents the leading end of the sheet $M_1$ from rounding or drooping, so that the sheet $M_1$ is discharged toward the discharging direction $P_1$ as illustrated in FIG. 9.

Figure 10:
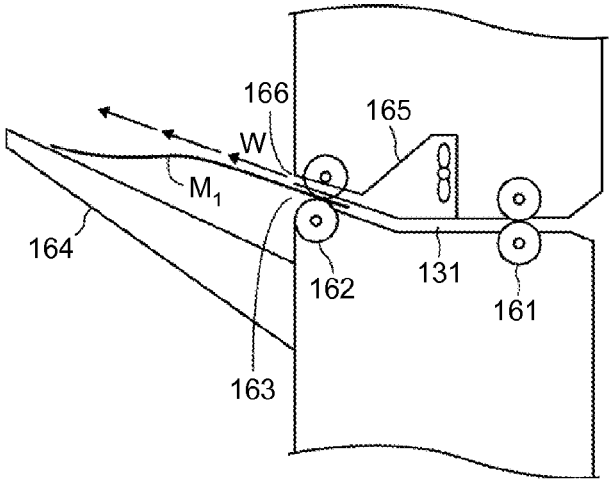
FIG. 10 is a diagram illustrating behavior of the sheet M1 in an instant just before an end of discharge according to the first example embodiment.

FIG. 10 is a diagram illustrating behavior of the sheet $M_1$ in an instant just before an end of discharge according to the first embodiment. The air flow W has a flow velocity lower at the leading end of the sheet $M_1$ than immediately after having been blown out of the air blowing port 166, so that the pressure difference between the upper surface and the lower surface of the sheet $M_1$ caused by the air flow W is small at the leading end of the sheet $M_1$. As a result, the force in the sheet $M_1$ to raise its leading end gradually decreases with the progress in the discharge of the sheet $M_1$, so that the force in the sheet $M_1$ to resist the gravitational force is weakened as the leading end of the sheet $M_1$ is away further from the discharging roller 162. This results in the leading end of the sheet $M_1$ gradually lowering with the progress in the discharge of the sheet $M_1$ as illustrated in FIG. 10. After the end of the discharge, the sheet $M_1$ falls down onto, and is stacked on, the tray unit 164.

Figure 27:
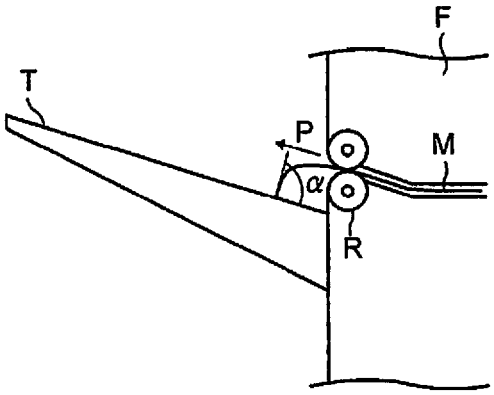
Conventional Art FIG.27
FIG. 27 is a diagram illustrating an exemplary discharge fault resulting from rounding of a recording medium in an image forming apparatus.

According to the first embodiment, air is blown on the upper surface of the sheet to be discharged in a direction parallel with the discharging direction $P_1$ to thereby produce a pressure difference between the upper surface and the lower surface of the sheet. This pressure difference generates a force in the sheet to lift upwardly, thus preventing the leading end of the sheet from rounding or drooping. As a result, discharging performance aggravated by, for example, rounding of the sheet as illustrated in FIG. 27 can be improved.

Figure 28:
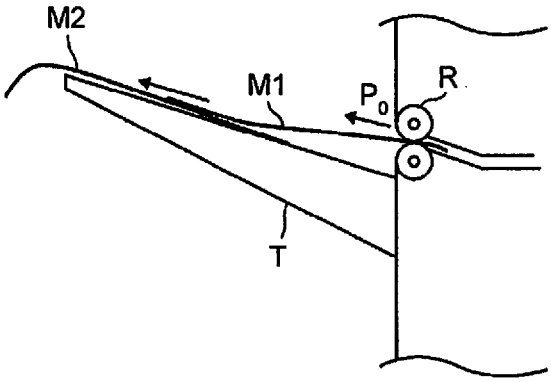
Conventional Art FIG.28
FIG. 28 is a diagram illustrating an exemplary discharge fault resulting from sticking of a sheet of paper in an image forming apparatus.

In the related-art technique, a fault occurs as illustrated in FIG. 28 in which a sheet M1 being discharged pushes a sheet M2 previously discharged. According to the first embodiment of the present invention, the sheet can be discharged with its leading end raised, which can eliminate such a problem.

The configuration of the image forming apparatus according to the first embodiment described above is not the only possible one and various changes may be made. This holds with other embodiments described in this specification.

For example, the image forming apparatus according to the first embodiment has been exemplified as incorporating an intermediate transfer system using toner. This is, however, not the only possible arrangement; alternatively, the present invention may be applied to an image forming apparatus that incorporates, for example, a direct transfer system or an ink jet system.

In addition, the first embodiment has been exemplarily described to form an image using toner of the four different colors of C, M, Y, and K. This is, however, not the only possible arrangement; alternatively, a possible configuration may use, for example, toner of a single color only, or toner of another color or transparent toner, in addition to the four colors of C, M, Y, and K.

Additionally, the image forming apparatus according to the first embodiment has been exemplified as including the discharging unit 16 built therein for a recording medium discharging unit. Nonetheless, the recording medium discharging unit is not necessarily built into the image forming apparatus and may still be incorporated in a freestanding post-processing system, for example, a finisher.

The program stored in the ROM 1811*a* may be one recorded in a computer-readable recording medium such as a CD-ROM, an FD, a CD-R, and a DVD as a file in an installable format or an executable format.

In the first embodiment, out of the discharging roller 162, the roller in contact with the upper surface of the sheet has a rotating shaft disposed above the air blowing port 166. This is, however, not the only possible arrangement; alternatively, for example, the rotating shaft of the roller may pass within the air blowing unit 165.

The first embodiment has been exemplarily described that the air blow is started after sheet has been conveyed onto the discharging unit 16 and stopped after all sheets of sheet on the conveying path 131 have been discharged out of the inside of the image forming apparatus. Nonetheless, as long as the behavior of the sheet described with reference to the first embodiment of the present invention occurs, the timings at which to start and stop the air blow may be changed as appropriate. For example, the air blow is started simultaneously with the start of discharge of the leading end of the sheet from the discharging port and stopped simultaneously with the end of discharge of the trailing end of the sheet; still alternatively, the air blow is stopped before the discharge of the sheet is completed.

Second Embodiment

Figure 11:
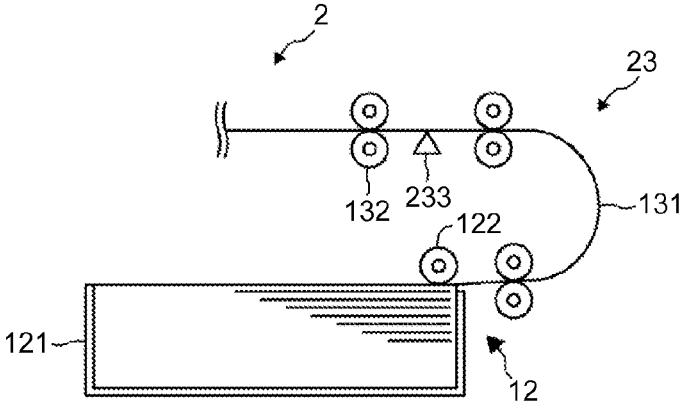
FIG. 11 is a configuration diagram illustrating a section covering from a sheet feeding unit 12 to registration rollers 132 according to a second example embodiment.

A second embodiment of the present invention will be described with reference to FIGS. 11 to 13. An image forming apparatus 2 according to the second embodiment of the present invention is configured such that, in addition to the arrangements of the image forming apparatus 1 according to the first embodiment, an air blowing fan 1653 has a speed that is variable according to a sheet to be conveyed.

A configuration of the second embodiment of the present invention will be described. The second embodiment is the same as the first embodiment except that a conveying unit 23 and a control unit 28 have functional configurations different from those of the conveying unit 13 and the control unit 18 of the first embodiment. The conveying unit 23 and the control unit 28 that differ from the conveying unit 13 and the control unit 18 of the first embodiment will therefore be described and descriptions for others will be omitted.

A configuration of the conveying unit 23 according to the second embodiment will be described with reference to FIG. 11.

The conveying unit 23 includes a sheet information detecting sensor 233 in addition to the configuration of the conveying unit 13 according to the first embodiment. Referring to FIG. 11, the sheet information detecting sensor 233 is disposed at a position on a conveying path 131 closer to the sheet feeding unit 12 relative to the registration rollers 132.

The sheet information detecting sensor 233 detects sheet information that serves as information on size, thickness, and weight of sheet being conveyed. Specifically, the sheet information detecting sensor 233 is a sensor unit including a sheet size detecting sensor that detects the size of the sheet, a sheet thickness detecting sensor that detects the thickness of the sheet, and a sheet weight detecting sensor that detects weight of the sheet.

The conveying unit 23 is otherwise configured similarly to the conveying unit 13 according to the first embodiment and descriptions for those similar configurations will be omitted.

A functional configuration of the control unit 28 according to the second embodiment will be described with reference to FIG. 12.

Figure 12:
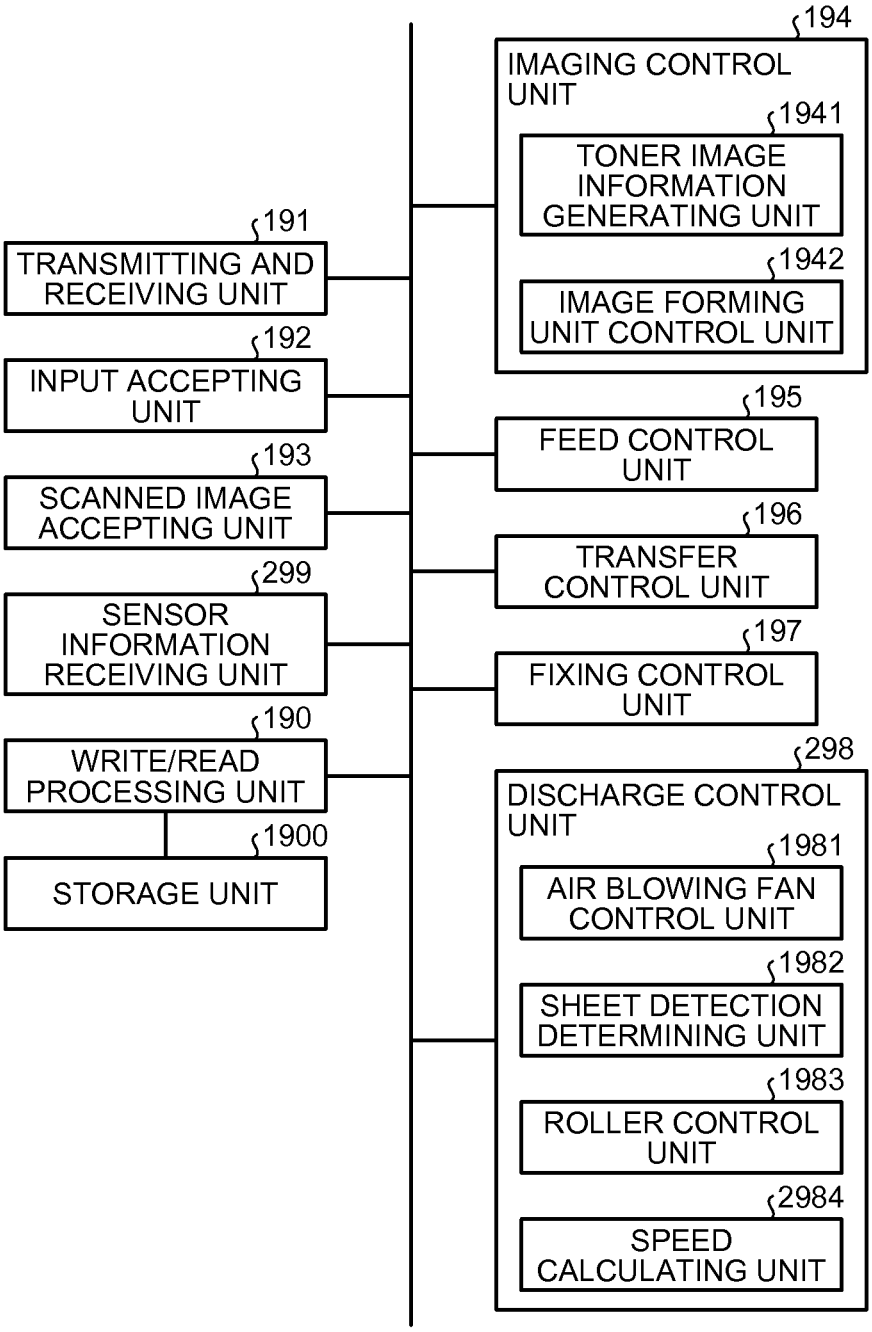
FIG. 12 is a functional configuration diagram illustrating a control unit 28 according to the second example embodiment.
Figure 13:
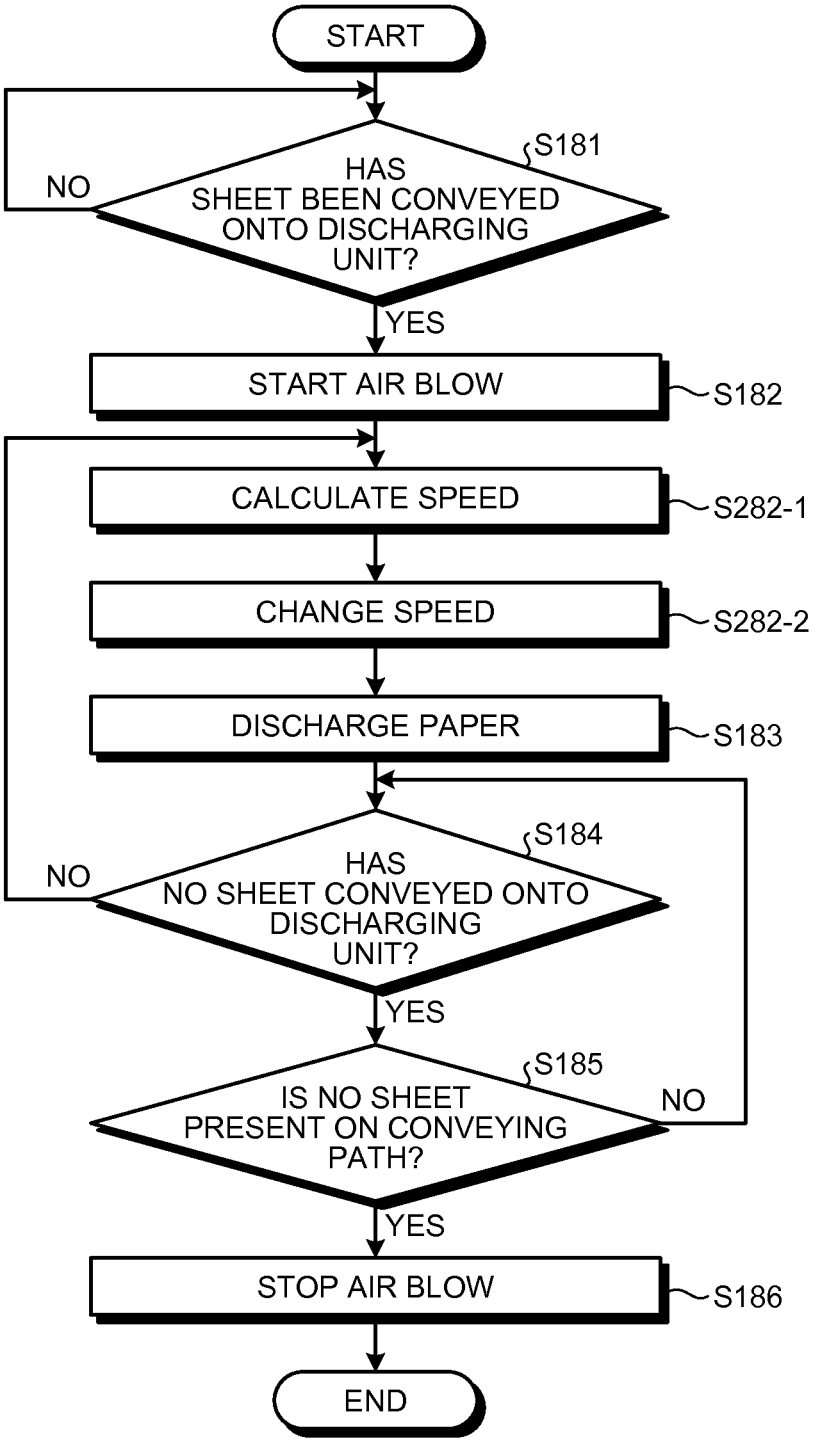
FIG. 13 is a flowchart illustrating a discharging operation according to the second example embodiment.

Referring to FIG. 12, the control unit 28 includes a sensor information receiving unit 299 and, in a discharge control unit 298, a speed calculating unit 2984, in addition to the functional configuration of the control unit 18 according to the first embodiment. The control unit 28 is otherwise functionally configured similarly to the control unit 18 according to the first embodiment and descriptions for those similar configurations will be omitted.

The sensor information receiving unit 299 receives sheet information from the sheet information detecting sensor 233 disposed on the conveying path 131. The speed calculating unit 2984 of the discharge control unit 298 calculates speed of an air blowing fan 1653. Specifically, the speed calculating unit 2984 calculates a speed of the air blowing fan 1653 that results in a flow velocity of air flow for producing a pressure difference required for raising the sheet based on, for example, the sheet information, a shape of an air blowing unit, and a sheet discharge speed. The calculated speed is stored in the storage unit 1900 and an air blowing fan control unit 1981 rotates the air blowing fan 1653 at this stored speed.

Operation in the second embodiment will be described. Steps in general operations of the image forming apparatus 2 according to the second embodiment are the same as those of the first embodiment illustrated in FIG. 7.

Control of an air blowing unit 165 for a discharge operation according to the second embodiment will be described with reference to FIG. 13. Control steps for the air blowing unit 165 during the discharge operation according to the second embodiment illustrated in FIG. 13 are the same as those in the first embodiment, except that Step S282-1 and Step S282-2 are added to the control steps for the air blowing unit 165 during the discharge operation according to the first embodiment illustrated in FIG. 8. The two different steps, Step S282-1 and Step S282-2, will therefore be described and descriptions for other steps will be omitted.

To describe the operation steps, as in the first embodiment, when it is determined that the sheet has conveyed onto a discharging unit 16, the air blowing fan control unit 1981 causes the air blowing unit 165 to start air blow (Step S182).

For the sheet conveyed onto the discharging unit 16, the sheet information detecting sensor 233 has previously detected the sheet information on its size, thickness, and weight at a position before the registration rollers 132 and the sensor information receiving unit 299 has previously received this information. At Step S282-1, the speed calculating unit 2984 calculates the speed of the air blowing fan 1653 required for raising the sheet to be discharged based on, for example, the sheet information received from the sensor information receiving unit 299.

At Step S282-2, the air blowing fan control unit 1981 changes the speed of the air blowing fan 1653 to that calculated at Step S282-1.

Thereafter, as in the first embodiment, a roller control unit 1983 rotates a discharging roller 162 to thereby discharge the sheet that has reached the discharging unit 16 out through a discharging port 163 (Step S183).

According to the second embodiment, the speed of the air blowing fan 1653 that results in a vacuum required for raising the sheet being produced is calculated based on, for example, the size, thickness, and weight of the sheet to be discharged and the air blowing fan 1653 is rotated at this speed. A discharging quality can therefore be achieved even when the sheet to be discharged is changed.

In the second embodiment, the speed of the air blowing fan 1653 is calculated based on the size, thickness, and weight of the sheet as the sheet information. This is, however, not the only possible arrangement; alternatively, the speed of the air blowing fan 1653 may be calculated using, for example, the quality of the sheet to be conveyed as the sheet information. Alternatively, the sheet information may be detected at, for example, a sheet storage 121, instead of along the conveying path 131. Still alternatively, information input from the operating unit 17 or an external device that can communicate with the image forming apparatus 2 may be used.

Additionally, in the second embodiment, the sheet information detecting sensor 233 are disposed separately from sheet detecting sensors. The image forming apparatus 2 may nonetheless be configured such that the sheet detecting sensors function also as the sheet information detecting sensor 233.

Third Embodiment

A third embodiment of the present invention will be described with reference to FIGS. 14 to 22. An image forming apparatus 3 according to the third embodiment is configured such that, in addition to the arrangements of the image forming apparatus 1 according to the first embodiment, a discharging unit includes an air blowing guide. The second embodiment is otherwise configured similarly to the first embodiment. Therefore, the third embodiment will be described only for the air blowing guide and descriptions for others will be omitted.

Figure 14:
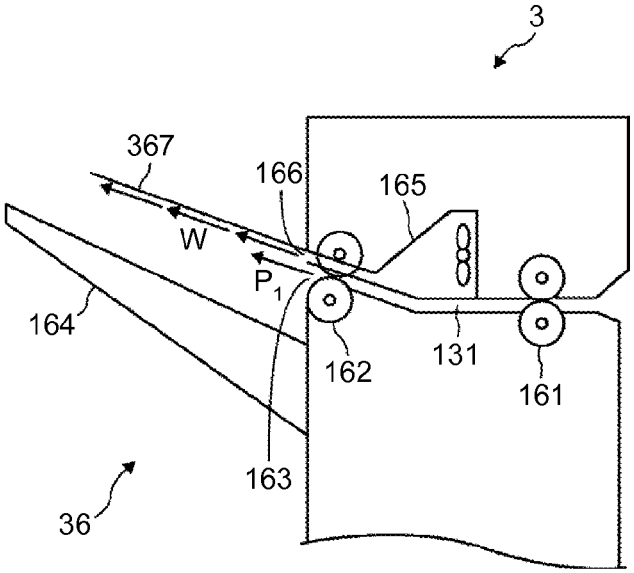
FIG. 14 is a configuration diagram illustrating a discharging unit 36 according to a third example embodiment.
Figure 15:
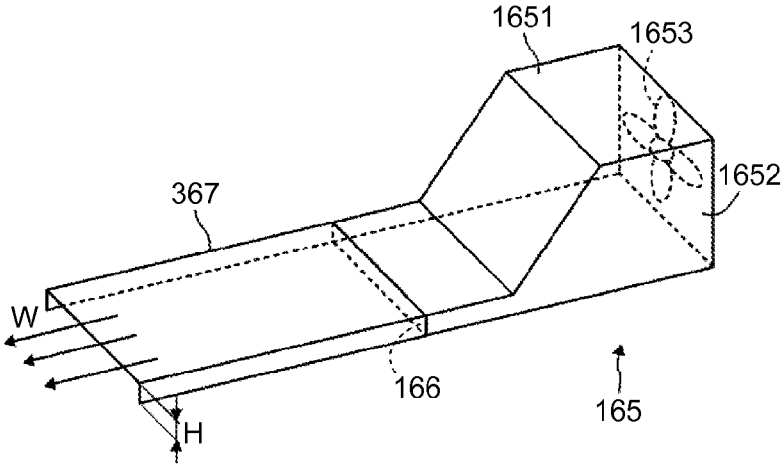
FIG. 15 is a configuration diagram illustrating an air blowing unit 165 and an air blowing guide 367 according to the third example embodiment.

A configuration of a discharging unit 36 according to the third embodiment will be described. FIG. 14 is a configuration diagram illustrating the discharging unit 36 according to the third embodiment. FIG. 15 is a perspective view illustrating an air blowing unit 165 according to the third embodiment.

Referring to FIG. 14, the discharging unit 36 includes the conveying roller 161, the discharging roller 162, the discharging port 163, the tray unit 164, the air blowing unit 165, the air blowing port 166, and an air blowing guide 367. Configurations and operation of different parts other than the air blowing guide 367 are the same as those in the first embodiment.

Referring to FIG. 14, the air blowing guide 367 is disposed at the air blowing port 166 such that a guiding direction extends in parallel with the discharging direction $P_1$ of the sheet.

Referring to FIG. 15, the air blowing guide 367 has a cross section having a size identical to that of the air blowing port 166. The air blowing guide 367 includes an upper surface and side surfaces that enclose air flow W discharged from the air blowing port 166. The air blowing guide 367 has an open lower side on the side adjacent to the sheet to be discharged.

The air blowing guide 367 has a height H that is equal to a height of the air blowing port 166. The height H is such that an upper surface of the sheet being discharged from the discharging port 163 touches or is about to touch lower ends of the two side surfaces of the air blowing guide 367. The air flow W blown out of the air blowing port 166 travels through the air blowing guide 367 in a condition of being restricted by the upper surface and the side surfaces and dispersed less.

Figure 16:
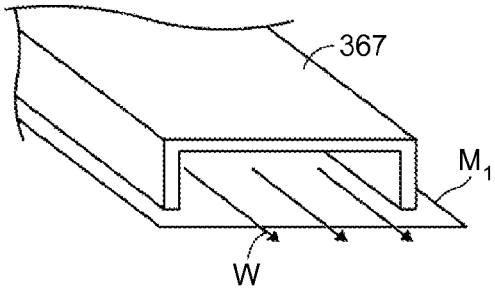
FIG. 16 is a schematic diagram illustrating a relationship between the air blowing guide 367 and a sheet M1 according to the third example embodiment.

FIG. 16 is a schematic diagram illustrating a relationship between the air blowing guide 367 and a sheet $M_1$ according to the third embodiment.

Referring to FIG. 16, the sheet $M_1$ is discharged from the discharging port 163 such that portions near both sides of the sheet $M_1$ move along the lower ends of the side surfaces of the air blowing guide 367. As the discharge of the sheet $M_1$ progresses, the open lower side of the air blowing guide 367 is closed by the sheet $M_1$ being discharged. As a result, an inflow of outside air into the air blowing guide 367 decreases, so that reduction in the flow velocity of the air flow W caused by the inflow of the outside air can be prevented and the air pressure in the air blowing guide 367 can be more easily reduced by the air flow W.

According to the third embodiment, the upper surface and the side surfaces of the air blowing guide 367 minimize dispersion of the air flow, which allows the air pressure in the air blowing guide 367 to be reduced easily. Further, the closure of the open lower side of the air blowing guide 367 by the sheet $M_1$ allows the air pressure in the air blowing guide 367 to be more easily reduced. A pressure difference between the upper surface and the lower surface of the sheet $M_1$ can then be produced more easily, so that a force to raise the sheet $M_1$ can be efficiently generated.

According to the third embodiment, the sheet $M_1$ is discharged along the air blowing guide 367. This minimizes an unsteady undulation of the sheet $M_1$ being discharged. Thus, having an adequate length of the air blowing guide 367 enables the sheet $M_1$ to be stacked in a predetermined position and posture.

First to third modifications of the third embodiment including air blowing guides 367 having modified shapes will be described below with reference to FIGS. 17 to 21.

Figure 17:
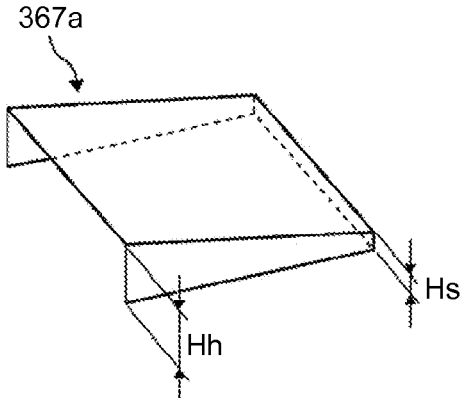
FIG. 17 is a schematic diagram illustrating an air blowing guide 367*a* according to a first modification of the third example embodiment.

FIG. 17 is a perspective view illustrating an air blowing guide 367*a* according to the first modification of the third embodiment. The air blowing guide 367*a* has a cross-sectional area that gradually increases from a position near the air blowing port 166 toward an air blowing direction. Specifically, the air blowing guide 367*a* illustrated in FIG. 17 has a side surface with a height Hh at a leading end portion thereof greater than a height Hs at a portion thereof mounted on the air blowing port 166, specifically, Hh>Hs. It is noted that the air blowing guide 367*a* is disposed such that lower ends of both side surfaces thereof extend in parallel with the discharging direction $P_1$ of the sheet illustrated in FIG. 14.

In the configuration of the first modification, the air blowing guide 367*a* has the side surfaces with a height gradually increasing toward the air blowing direction, which results in a larger cross-sectional area of the air blowing guide 367*a* closer to the leading end of the air blowing guide 367*a*.

Therefore, the flow velocity of the air flow inside the air blowing guide 367*a* decreases more and thus the air pressure on the upper surface of the sheet reduces lesser toward the leading end of the air blowing guide 367*a*. Thus, the pressure difference between the upper surface and the lower surface of the sheet is smaller at the leading end of the air blowing guide 367*a* than at the air blowing port 166.

As a result, the force to raise the sheet decreases at the leading end of the air blowing guide 367*a* and, when the leading end of the sheet approaches the leading end of the air blowing guide 367*a*, the leading end of the sheet leaves the lower ends of the two side surfaces of the air blowing guide 367*a*.

This results in air in areas around the leading end of the air blowing guide 367*a* flowing in via the lower surface of the air blowing guide 367*a*. This further reduces the air pressure inside the air blowing guide 367*a*, so that the force to raise the sheet is lost and the sheet being discharged falls. Through such behavior, the sheet is stacked at a predetermined position, so that sheet placement can be performed even more steadily.

Figure 18:
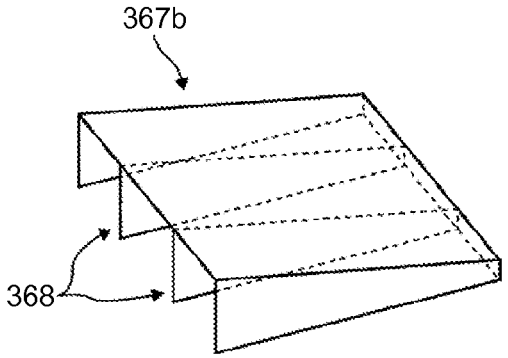
FIG. 18 is a schematic diagram illustrating an air blowing guide 367*b* according to a second modification of the third example embodiment.

FIG. 18 is a perspective view illustrating an air blowing guide 367*b* according to the second modification of the third embodiment. The air blowing guide 367*b* includes a baffle plate 368 thereinside.

Referring to FIG. 18, the baffle plates 368 are disposed inside the air blowing guide 367*b*, extending from the air blowing port 166 toward the leading end of the air blowing guide 367*b*.

The baffle plates 368 rectify a flow pattern of the air flow inside the air blowing guide 367*b*. For example, the air blowing unit 165 rotates the air blowing fan 1653 to thereby generate air, which causes, for example, minor air flow turbulence or swirl to occur inside the air blowing guide 367*b*. The baffle plates 368 can rectify the swirl or air flow turbulence that has occurred so as to flow in the discharging direction of the sheet.

Figure 19:
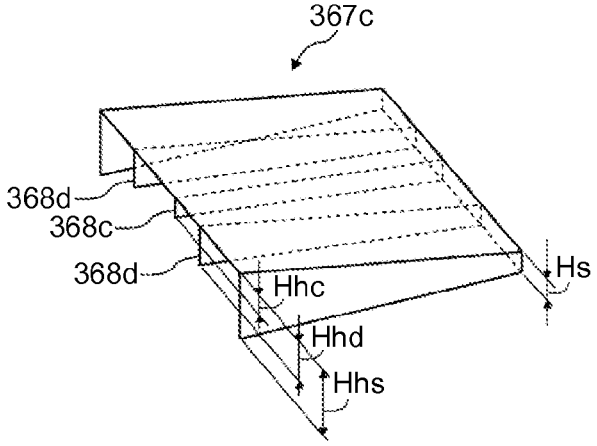
FIG. 19 is a schematic diagram illustrating an air blowing guide 367*c* according to a third modification of the third example embodiment.

FIG. 19 is a perspective view illustrating an air blowing guide 367*c* according to the third modification of the third embodiment.

Referring to FIG. 19, the air blowing guide 367*c* includes baffle plates 368*c* and 368*d* attached thereto, the air blowing guide 367*c*, the baffle plate 368*c*, and the baffle plates 368*d* having different heights from one another. The baffle plate 368*c* is disposed at a center inside the air blowing guide 367*c*. Each of the baffle plates 368*d* is disposed between one side surface of the air blowing guide 367*c* and the baffle plate 368*c*. The baffle plate 368*c* and the baffle plates 368*d* are spaced equidistantly between the two side surfaces of the air blowing guide 367*c*.

At a portion of the air blowing guide 367*c* mounted on the air blowing port 166, the both side surfaces of the air blowing guide 367*c*, the baffle plate 368*c*, and the baffle plates 368*d* each have a height Hs that is identical to one another.

At the leading end of the air blowing guide 367*c*, let Hhs be a height of the side surface of the air blowing guide 367*c*, Hhd be a height of each of the baffle plate 368*d* adjacent to the respective side surfaces of the air blowing guide 367*c*, and Hhc be a height of the center baffle plate 368*c*. Then, a relation of Hhs>Hhd>Hhc holds. Specifically, the center baffle plate 368*c*, the baffle plates 368*d*, and the side surface of the air blowing guide 367*c* have gradually increasing heights toward the side surfaces of the air blowing guide 367*c*. The air blowing guide 367*c* thus has an open lower side that forms a shape centrally recessed by lower ends of the center baffle plate 368*c*, the baffle plates 368*d*, and the side surfaces of the air blowing guide 367*c*.

Figure 20:
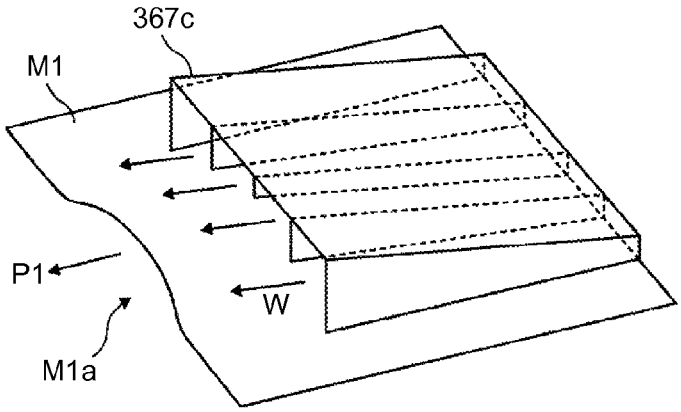
FIG. 20 is a schematic diagram illustrating the air blowing guide 367*c* and a sheet M1 according to the third modification of the third example embodiment.

FIG. 20 is a schematic diagram illustrating a movement of sheet M1 when the air blowing guide 367*c* illustrated in FIG. 19 is used. Referring to FIG. 20, when the sheet M1 is discharged along the air blowing guide 367*c*, the air pressure inside the air blowing guide 367*c* decreases, which raises the sheet M1.

In this case, the movement of the sheet M1 moving upward is restricted as follows: specifically, first, both side portions of the sheet M1 are restricted by the lower ends of the two side surfaces of the air blowing guide 367*c*; then, portions near the center and the very center of the sheet M1 are restricted by the lower ends of the two baffle plates 368*d* and the baffle plate 368*c*.

As a result, the sheet M1 is discharged having a shape following the recessed shape of the open lower side of the air blowing guide 367*c*, specifically, a shape M1*a* that is the sheet M1 with a centrally curved mountain shape. The centrally curved mountain shape M1*a* gives the sheet M1 an additional longitudinal strength that resists longitudinal deformation. This prevents rounding or drooping of sheet as illustrated in FIG. 27.

A case in which sheet is discharged by a discharging roller 362 having a taper shape will be described below with reference to FIG. 21.

Figure 21:
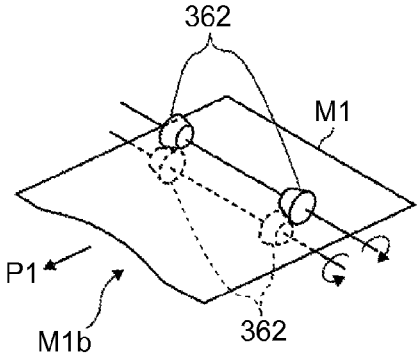
FIG. 21 is a schematic diagram illustrating a discharging roller 362 and the sheet M1 according to third modification of the third example embodiment.

Referring to FIG. 21, the discharging rollers 362 include upper rollers disposed on the upper side of the sheet M1 and lower rollers disposed on the lower side of the sheet M1. Each of the upper rollers has a taper shape with a smaller diameter on the inside, while each of the lower rollers has a taper shape with a smaller diameter on the outside. The tapers of the discharging rollers 362 form a centrally curved mountain shape M1*b* in the sheet M1 while the sheet M1 is being discharged.

In this case, preferably, differences in height among the two side surfaces of the air blowing guide 367*c*, the baffle plate 368*c*, and the baffle plates 368*d* are arranged so that a curved profile in the sheet formed by the tapers of the discharging rollers 362 is followed.

Figure 22:
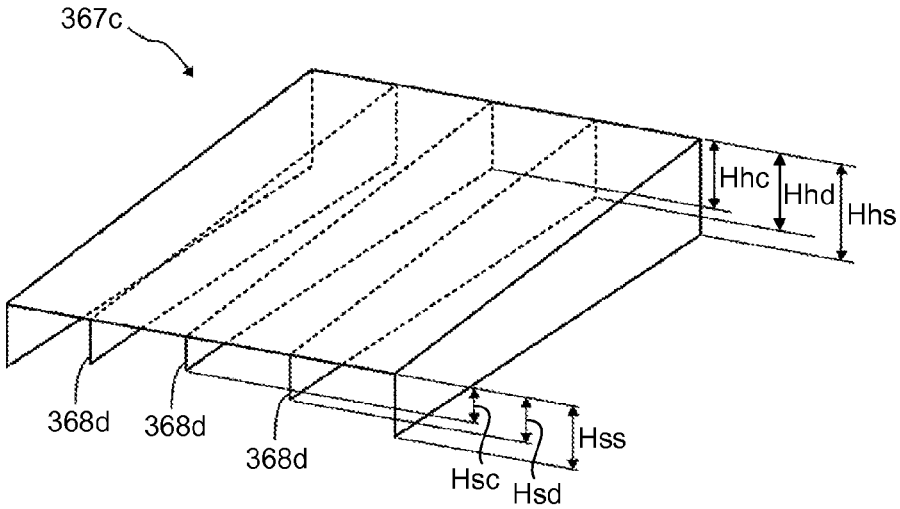
FIG. 22 is a schematic diagram illustrating the air blowing guide 367*c* according to third modification of the third example embodiment.

FIG. 22 illustrates an air blowing guide 367*c* having differences in height not only at the leading end of the air blowing guide 367*c*, but also at the portion of the air blowing guide 367*c* mounted on the air blowing port 166. At the portion of the air blowing guide 367*c* mounted on the air blowing port 166, let Hss be a height of each of the side surfaces of the air blowing guide 367*c*, Hsd be a height of each of the baffle plates 368*d* adjacent to the side surfaces of the air blowing guide 367*c*, and Hsc be a height of the center baffle plate 368*c*. Then, a relation of Hss>Hsd>Hsc holds so that a curved profile in the sheet M1 formed by the tapers of the discharging rollers 362 is followed. Similarly, at the leading end of the air blowing guide 367*c*, a relation of Hhs>Hhd>Hhc holds so that the curved profile in the sheet M1 formed by the tapers of the discharging rollers 362 is followed.

As such, the air blowing guide 367*c* has differences in height also at its portion mounted on the air blowing port 166. Thus, the portion of the sheet M1 in contact with the air blowing guide 367*c* is adapted to follow along the center curved profile in the sheet M1 formed by the discharging rollers 362. As a result, the center curved profile in the sheet formed by the discharging rollers 362 is maintained even after the discharge, so that the sheet can be prevented from drooping as illustrated in FIG. 27.

It is noted that, if the discharging roller 362 is used with the air blowing guide 367*c* illustrated in FIG. 19, the curve at the center of the sheet M1 is to be formed by the tapers of the discharging roller 362 and the air blowing guide 367*c*.

Additionally, in the third embodiment, the heights of the baffle plates are arranged so as to increase toward the side surfaces of the air blowing guide 367*c* from the center baffle plate 368*c* that has the lowest height Hhc. This is, however, not the only possible arrangement and any other ones are possible as long as a centrally curved mountain shape can be formed in the sheet being discharged as in this embodiment.

One possible arrangement is to form a centrally curved valley shape in which the center baffle plate 368*c* has the highest heights Hhc and Hsc to make the following inequalities valid, Hhc>Hhd>Hhs and Hsc>Hsd>Hss; specifically, the baffle plates 368*c* and 368*d* have decreasing heights toward the side surfaces of the air blowing guide 367*c*. Another possible arrangement includes baffle plates having high and low heights disposed alternately to thereby produce curves in the sheet at a plurality of places.

FIGS. 18, 19, and 22 illustrate arrangements in which the leading ends of the air blowing guides 367*b* and 367*c* have a height higher than that of the portions of the air blowing guides 367*b* and 367*c* mounted on the air blowing port 166. The arrangements do not, however, represent the only possible shapes of the air blowing guides 367*b* and 367*c*. For example, a baffle plate may be attached to an air blowing guide, such as the air blowing guide 367 illustrated in FIG. 15. Additionally, the number of baffle plates is not limited to the number illustrated in the third embodiment.

In addition, the change in the cross-sectional area of the air blowing guide 367 is achieved by changing the height of the air blowing guide 367*a*. Instead of the foregoing, the air blowing guide 367*a* may have a wider crosswise width. The same also holds with the change in the cross-sectional areas of the air blowing guides 367*b* and 367*c*.

In addition, the third embodiment has been described as a configuration of the first embodiment to which the air blowing guide is mounted. Each of the configurations of the air blowing guides in the third embodiment may nonetheless be applied to the second embodiment.

Fourth Embodiment

A fourth embodiment of the present invention will be described with reference to FIGS. 23 to 26. An image forming apparatus 4 according to the fourth embodiment includes the image forming apparatus 3 of the third embodiment to which a second discharging port and a second conveying path leading to the second discharging port are added. The image forming apparatus 4 thereby enables sheet to be selectively discharged out through either one of the two discharging ports and the sheet discharged through the second discharging port to be stacked on an upper surface of an air blowing guide.

The fourth embodiment is the same as the first embodiment except in configurations of a conveying unit 43 and a discharging unit 46, and a control unit 48. The conveying unit 43, the discharging unit 46, and the control unit 48 will therefore be described and descriptions for others will be omitted.

Figure 23:
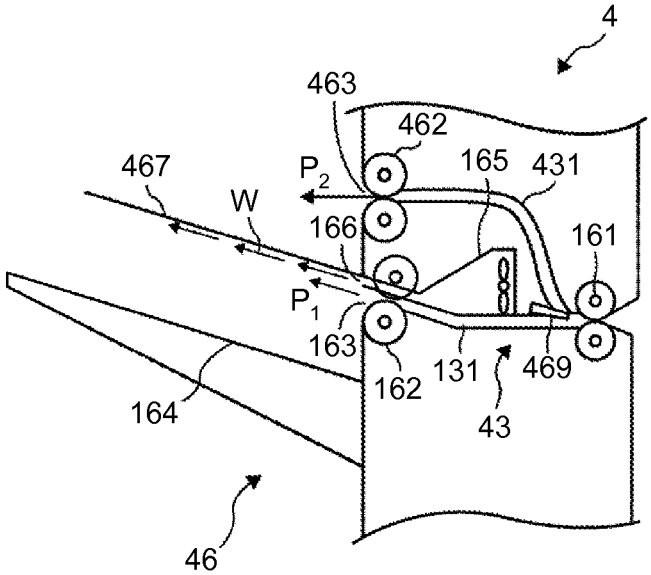
FIG. 23 is a configuration diagram illustrating a discharging unit 46 according to a fourth example embodiment.
Figure 24:
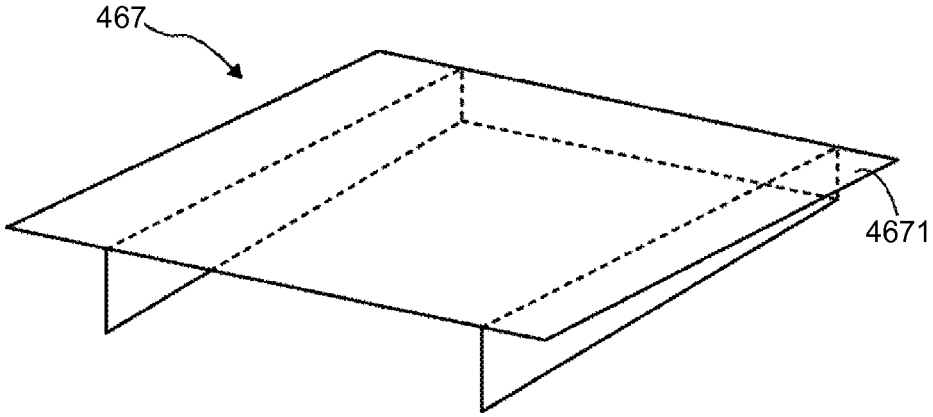
FIG. 24 is a configuration diagram illustrating an air blowing guide 467 according to the fourth example embodiment.

Referring to FIG. 23, the conveying unit 43 includes a conveying path 431 that branches from the conveying path 131 in the discharging unit 46, in addition to the configuration of the conveying unit 13 according to the first embodiment. The discharging unit 46 includes a discharging roller 462, a discharging port 463, an air blowing guide 467, and a discharge switching pawl 469, in addition to the configuration of the discharging unit 16 of the first embodiment.

The conveying path 431 extends upwardly of the air blowing unit 165 from a branch point from the conveying path 131. Paper conveyed onto the conveying path 431 is discharged from the discharging port 463 disposed upwardly of the air blowing port 166.

The air blowing guide 467 is mounted on the air blowing port 166 so as to extend in parallel with the discharging direction P1. The air blowing guide 467 is formed such that the sheet discharged by the discharging roller 462 can be stacked on an upper surface of the air blowing guide 467. For example, to enable the air blowing guide 467 to have a sufficient area on which to place the sheet, the air blowing guide 467 has a top panel 4671 disposed on the upper surface thereof.

The discharge switching pawl 469 is disposed at the branch point on the conveying path 131 to the conveying path 431. The discharge switching pawl 469 rotates to thereby allow sheet that has been conveyed along the conveying path 131 by the conveying roller 161 to be selectively conveyed directly through the conveying path 131 and discharged from the discharging port 163, or to be conveyed onto the conveying path 431 and discharged from the discharging port 463.

A functional configuration of the control unit 48 according to the fourth embodiment will be described with reference to FIG. 25.

Figure 25:
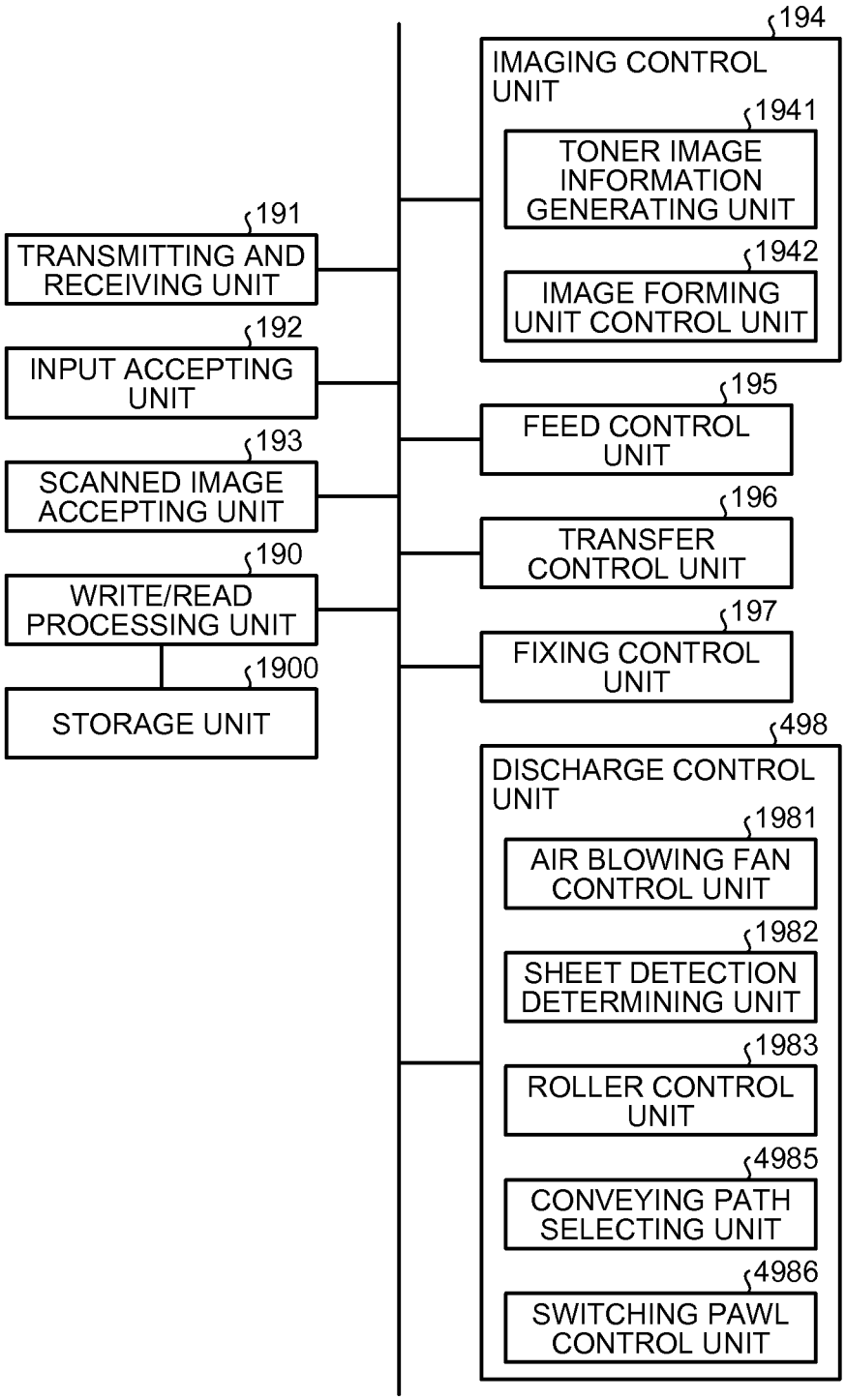
FIG. 25 is a functional configuration diagram illustrating a control unit 48 according to the fourth example embodiment.

Referring to FIG. 25, the control unit 48 includes, in a discharge control unit 498, a conveying path selecting unit 4985 and a switching pawl control unit 4986, in addition to the functional configuration of the control unit 18 of the first embodiment. The control unit 48 is otherwise functionally configured similarly to the control unit 18 according to the first embodiment and descriptions for those similar configurations will be omitted.

The conveying path selecting unit 4985 determines whether to change a direction of conveyance onto the conveying path 431 based on information input from a user or received from an external device such as an information processing apparatus. The switching pawl control unit 4986 controls operation of the discharge switching pawl 469 of the discharging unit 46.

Functions of the discharge control unit 498 other than the conveying path selecting unit 4985 and the switching pawl control unit 4986 are the same as those of the discharge control unit 198 of the first embodiment and descriptions therefor will be omitted.

Operation of the fourth embodiment of the present invention will be described below. Steps in general operations of the image forming apparatus 4 according to the fourth embodiment are the same as those of the first embodiment illustrated in FIG. 7.

Control of the discharging unit 46 in the fourth embodiment will be described with reference to FIG. 26.

Figure 8:
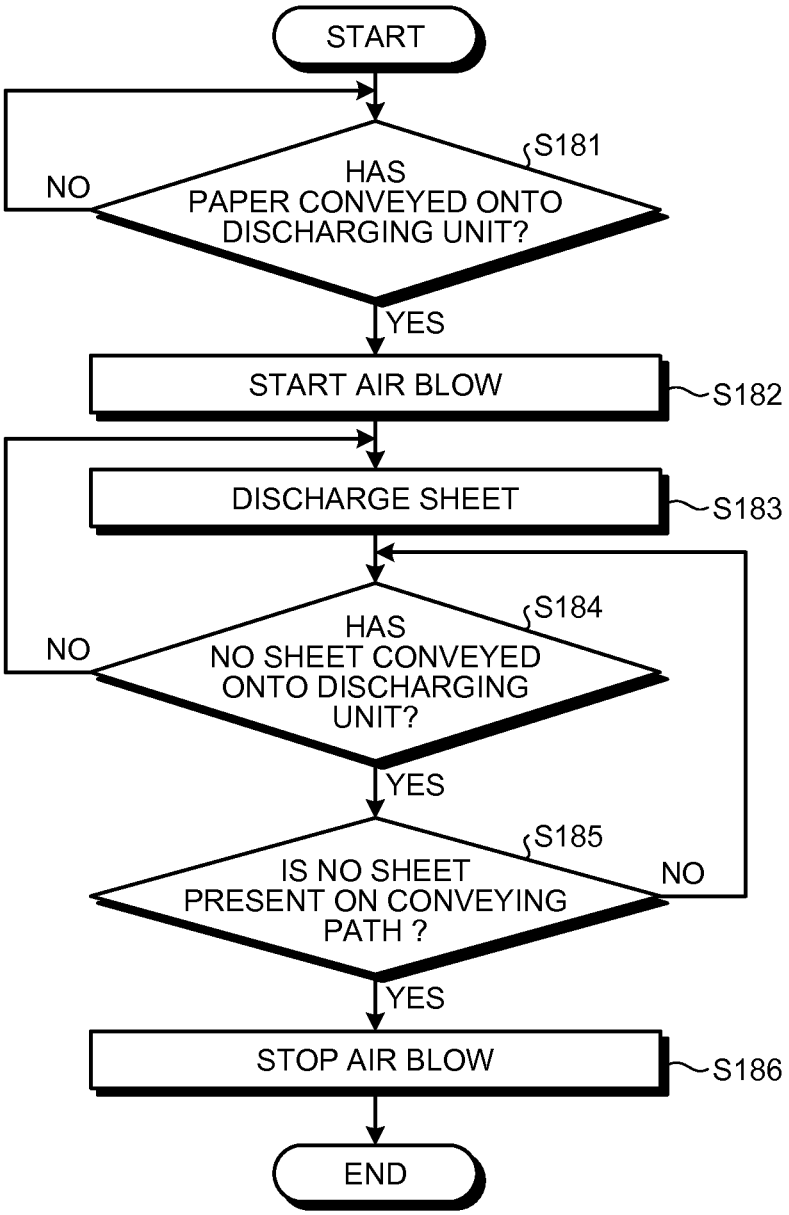
FIG. 8 is a flowchart illustrating a discharging operation according to the first example embodiment.
Figure 26:
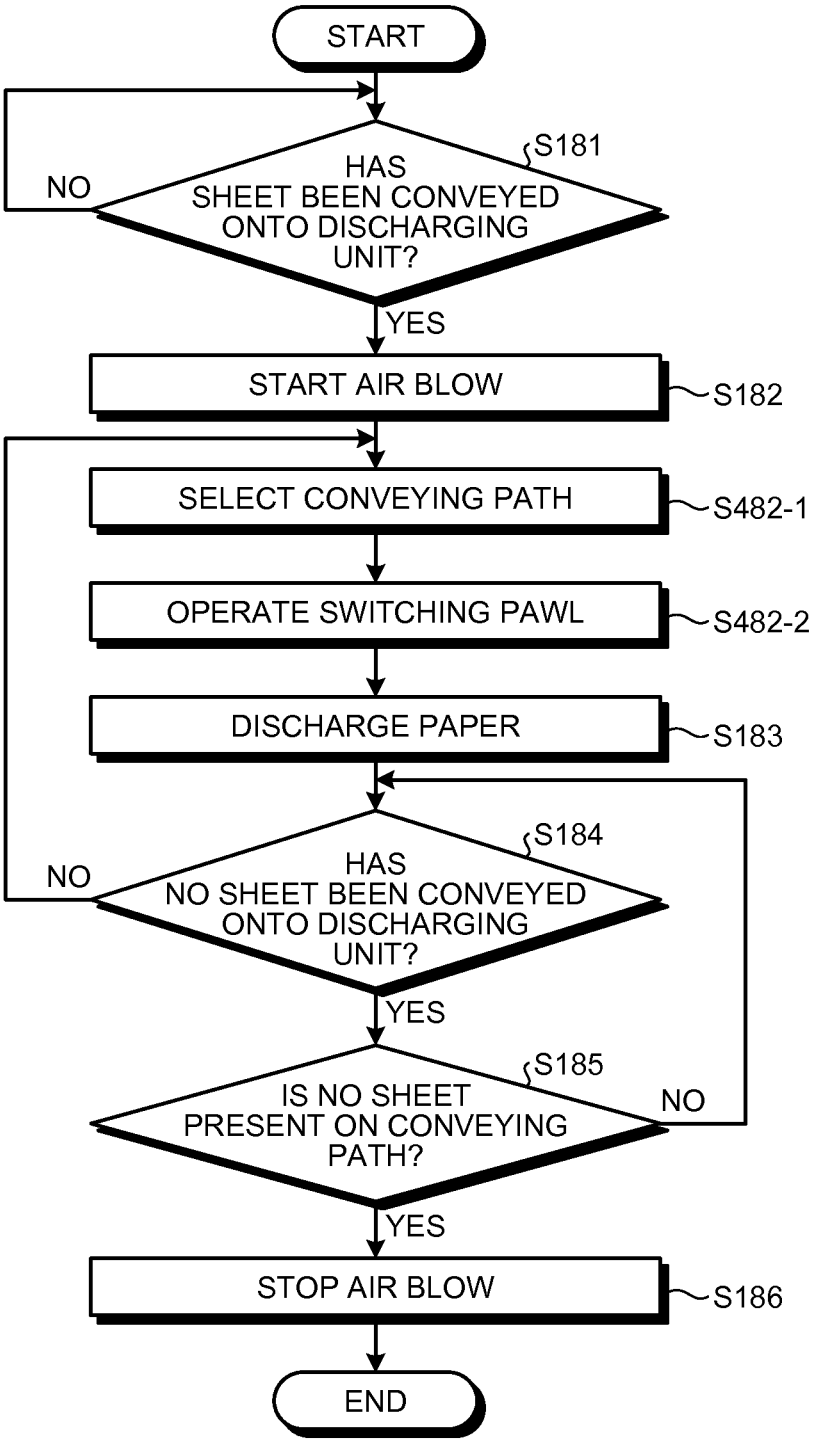
FIG. 26 is a flowchart illustrating a discharging operation according to the fourth example embodiment.

The control of the discharging unit 46 illustrated in FIG. 26 is the same as that in the first embodiment except that Step S482-1 and Step S482-2 illustrated in FIG. 26 are added to the control for the discharge operation in the first embodiment illustrated in FIG. 8. Step S482-1 and Step S482-2 are therefore described and the description of other steps will be omitted.

To describe the control steps, as in the first embodiment, when it is determined that sheet has conveyed onto the discharging unit 16, the air blowing fan control unit 1981 causes the air blowing unit 165 to start air blow (Step S182).

Next, the conveying path selecting unit 4985 determines whether to change the direction of conveyance onto the conveying path 431 (Step S482-1).

The switching pawl control unit 4986 operates the discharge switching pawl 469 such that the sheet can be conveyed in the direction determined by the conveying path selecting unit 4985 (Step S482-2).

Thereafter, as in the first embodiment, the roller control unit 1983 rotates the discharging roller 162 or the discharging roller 462 to thereby discharge the sheet that has reached the discharging unit 46 out through the discharging port 163 or the discharging port 463 (Step S183).

According to the fourth embodiment, the conveying path 431 that branches from the conveying path 131 and the discharge switching pawl 469 allows a placement site on which to place the sheet to be discharged to be changed. Paper can thereby be sorted into different sets stacked in different placement sites and a specific sorted set can be removed from a specific placement site.

The air blowing guide 467 can be used as a placement site and eliminates the need for having a separate placement site. This contributes to greater space saving of the image forming apparatus.

The air blowing guide 467 may not necessarily have the shape described in the fourth embodiment as long as a sufficient area for a placement site can be achieved. For example, the air blowing guide 467 may have a configuration such as any of those illustrated in the first to the third modifications of the third embodiment.

Additionally, the fourth embodiment may further include the sheet information acquiring sensor described with reference to the second embodiment. In this case, the conveying path can be selected based on sheet information acquired by the sheet information acquiring sensor.

According to the embodiments, the air blower blows air on the upper surface of the recording medium in the direction extending along the recording medium, to thereby reduce air pressure on the upper surface of the recording medium and raise the recording medium. This causes the recording medium to be discharged in a position nearly parallel with the surface of the tray unit, thus enhancing the discharging quality.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A recording medium discharging device comprising:

a pair of discharging rollers configured to discharge a recording medium from a discharge port;

a tray unit on which the recording medium discharged from the pair of discharging rollers is stacked;

an air blower configured to blow air in a direction in which the recording medium is discharged; and a control unit configured to control the air blower to blow air while the recording medium is being discharged, wherein the air blower includes an air blower duct disposed in between rotating shafts of the discharging rollers and an air blowing port disposed above the discharge port.

2. The recording medium discharging device according to claim 1, further comprising:

an air blowing fan functioning as the air blower;

a speed controller configured to control speed of the air blowing fan; and a recording medium information acquiring unit configured to acquire information on the recording medium, wherein the speed controller controls the speed of the air blowing fan in accordance with the information on the recording medium.

3. An image forming apparatus comprising the recording medium discharging device according to claim 1.

* * * * *